US011650009B2

(12) United States Patent
Butts

(10) Patent No.: US 11,650,009 B2
(45) Date of Patent: May 16, 2023

(54) SYSTEM AND METHOD FOR SEPARATING METHANE AND NITROGEN WITH REDUCED HORSEPOWER DEMANDS

(71) Applicant: BCCK Holding Company, Midland, TX (US)

(72) Inventor: Rayburn C. Butts, Midland, TX (US)

(73) Assignee: BCCK Holding Company, Midland, TX (US)

( * ) Notice: Subject to any disclaimer, the term of this patent is extended or adjusted under 35 U.S.C. 154(b) by 253 days.

(21) Appl. No.: 16/852,770

(22) Filed: Apr. 20, 2020

(65) Prior Publication Data

US 2021/0180864 A1 Jun. 17, 2021

Related U.S. Application Data

(63) Continuation-in-part of application No. 16/714,110, filed on Dec. 13, 2019, now Pat. No. 11,378,333.

(51) Int. Cl.
*F25J 3/02* (2006.01)

(52) U.S. Cl.
CPC ..... *F25J 3/0257* (2013.01); *F25J 3/0209* (2013.01); *F25J 2200/06* (2013.01);
(Continued)

(58) Field of Classification Search
CPC ..... F25J 3/0257; F25J 3/0209; F25J 2200/06; F25J 2200/40; F25J 2200/50;
(Continued)

(56) References Cited

U.S. PATENT DOCUMENTS 4,323,380 A 4/1982 Mueller et al.
4,331,461 A 5/1982 Karbosky et al.
(Continued)

FOREIGN PATENT DOCUMENTS

DE 2962561 2/1981
EP 1065457 1/2001
(Continued)

OTHER PUBLICATIONS

Gas Processors Association Europe, Weidert et al., Sep. 23, 2011. Retrieved from: https://gpaeurope.com/library/secure/integrated-systems-key-unlocking-gas-processing. Pub (Year: 2011).*
(Continued)

*Primary Examiner* — Miguel A Diaz
*Assistant Examiner* — Ibrahim A. Michael Adeniji
(74) *Attorney, Agent, or Firm* — Scheef & Stone, LLP; Robin L. Barnes

(57) ABSTRACT

A system and method for removing nitrogen from natural gas using two fractionating columns, that may be stacked, and a plurality of separators and heat exchangers, with horsepower requirements that are 50-80% of requirements for prior art systems. The fractionating columns operate at different pressures. A feed stream is separated with a vapor portion feeding the first column to produce a first column bottoms stream that is split into multiple portions at different pressures and first column overhead stream that is split or separated into two portions at least one of which is sub-cooled prior to feeding the top of the second column. Optional heat exchange between first column and second column streams provides first column reflux and reboil heat for a second column ascending vapor stream. Three sales gas streams are produced, each at a different pressure.

22 Claims, 2 Drawing Sheets

(52) U.S. Cl.
CPC ..... *F25J 2200/40* (2013.01); *F25J 2200/50* (2013.01); *F25J 2200/72* (2013.01); *F25J 2200/78* (2013.01); *F25J 2205/04* (2013.01); *F25J 2240/12* (2013.01); *F25J 2245/00* (2013.01); *F25J 2270/12* (2013.01)

(58) Field of Classification Search
CPC .. F25J 2200/72; F25J 2200/78; F25J 2205/04; F25J 2240/12; F25J 2245/00; F25J 2270/12; F25J 2200/04; F25J 2200/52; F25J 2205/02; F25J 2270/02; F25J 3/0233; F25J 3/0238
See application file for complete search history.

(56) References Cited

U.S. PATENT DOCUMENTS

| | | | | |
|---|---|---|---|---|
| 4,411,677 | A | 10/1983 | Pervier et al. | |
| 4,451,275 | A | 5/1984 | Vines et al. | |
| 4,474,591 | A | 10/1984 | Arand et al. | |
| 4,547,209 | A | 10/1985 | Netzer | |
| 4,609,390 | A | 9/1986 | Wilson | |
| 4,948,405 | A | 8/1990 | Thompson | |
| 5,041,149 | A | 8/1991 | Handley | |
| 5,051,120 | A | 9/1991 | Pahade et al. | |
| 5,141,544 | A | 8/1992 | Butts | |
| 5,257,505 | A | 11/1993 | Butts | |
| 5,375,422 | A | 12/1994 | Butts | |
| 6,116,051 | A | 9/2000 | Agrawal et al. | |
| 6,205,813 | B1 | 3/2001 | Shah et al. | |
| 7,520,143 | B2 | 4/2009 | Spilsbury | |
| 8,522,574 | B2 | 9/2013 | Crawford et al. | |
| 8,640,495 | B2 | 2/2014 | McNeil | |
| 8,869,553 | B2 | 10/2014 | Court et al. | |
| 9,816,752 | B2 | 11/2017 | Butts | |
| 9,920,986 | B2 | 3/2018 | Mak | |
| 2004/0177646 | A1 | 9/2004 | Wilkinson et al. | |
| 2004/0237581 | A1 | 12/2004 | Paradowski | |
| 2007/0180855 | A1 | 8/2007 | Butts | |
| 2010/0223950 | A1 | 9/2010 | Malsam | |
| 2011/0289963 | A1 | 12/2011 | Price | |
| 2012/0097520 | A1* | 4/2012 | Johnson | F25J 3/0209 203/91 |
| 2012/0324943 | A1* | 12/2012 | Butts | F25J 3/0257 62/630 |
| 2014/0013797 | A1 | 1/2014 | Butts | |
| 2015/0052938 | A1 | 2/2015 | Bauer et al. | |
| 2018/0231306 | A1* | 8/2018 | Butts | F25J 3/0238 |

FOREIGN PATENT DOCUMENTS

| | | |
|---|---|---|
| GB | 2208699 | 4/1989 |
| RU | 2121637 | 11/1998 |
| WO | WO2009144423 | 12/2009 |

OTHER PUBLICATIONS

Weidert et al., Integrated System The Key to Unlocking Gas Processing, Chart Energy and Chemicals, Inc., pp. 1-9.
Weidert et al., Integrated System The Key to Unlocking Gas Processing, Chart Energy and Chemicals, Inc., pp. 1-9, Presented on Sep. 23, 2011.
Weidert et al., Holding the Key Article, Hydrocarbon Engineering, Reprinted from Aug. 2016, https://files.chartindustries.com/HoldintheKey-NewsArticle.pdf, retrieved from the Internet Nov. 12, 2019.

* cited by examiner

SYSTEM AND METHOD FOR SEPARATING METHANE AND NITROGEN WITH REDUCED HORSEPOWER DEMANDS

CROSS REFERENCE TO RELATED APPLICATION

This application is a continuation-in-part of U.S. application Ser. No. 16/714,110 filed on Dec. 13, 2019.

BACKGROUND OF THE INVENTION

1. Field of the Invention

This invention relates to systems and methods for separating nitrogen from methane and other components from natural gas streams of around 20 MMSCFD or more with reduced energy/horsepower requirements compared to prior art systems and methods.

2. Description of Related Art

Nitrogen contamination is a frequently encountered problem in the production of natural gas from underground reservoirs. The nitrogen may be naturally occurring or may have been injected into the reservoir as part of an enhanced recovery operation. Transporting pipelines typically do not accept natural gas containing more than 4 mole percent inerts, such as nitrogen. As a result, the natural gas feed stream is generally processed to remove such inerts for sale and transportation of the processed natural gas.

One method for removing nitrogen from natural gas is to process the nitrogen and methane containing stream through a Nitrogen Rejection Unit or NRU. The NRU may be comprised of two cryogenic fractionating columns, such as that described in U.S. Pat. Nos. 4,451,275 and 4,609,390. These two column systems have the advantage of achieving high nitrogen purity in the nitrogen vent stream, but require higher capital expenditures for additional plant equipment, including the second column, and may require higher operating expenditures for refrigeration horsepower and for compression horsepower for the resulting methane stream.

The NRU may also be comprised of a single fractionating column, such as that described in U.S. Pat. Nos. 5,141,544, 5,257,505, and 5,375,422. Many single column systems have a single sales gas stream exiting the NRU fractionating column, usually at a lower pressure requiring compression to meet pipeline requirements. For example, in U.S. Pat. No. 5,141,544, an NRU feed stream is first processed to remove water and carbon dioxide (to avoid freezing problems associated in carbon dioxide) and is then split into three portions prior to feeding the single column NRU. A first portion is cooled through heat exchange with an overhead stream from the NRU column, a second portion is cooled through heat exchange with the NRU column bottoms stream, and a third portion is cooled through heat exchange with a side stream withdrawn from and returned to the NRU column in a reboiler for the NRU column. The first, second and third portions of the feed stream are recombined, the recombined stream is further cooled through heat exchange with the NRU column bottoms stream, and then passes through a JT valve prior to feeding into the NRU column as a liquid and vapor mixed phase stream around −215° F. and around 170 psia. The overhead stream from the single column NRU is the nitrogen vent stream. The single NRU bottoms stream is a sales gas stream at a pressure around 60 psia in the example in the '544 patent, requiring further compression.

Some single column systems also split the NRU column bottoms stream into two streams to allow for additional heat exchange with other process streams and resulting in two sales gas streams at different pressures. For example, in U.S. Pat. No. 5,375,422, an NRU feed stream is first processed to remove water and carbon dioxide and is then split into four portions prior to feeding the single column NRU. A first portion is cooled through heat exchange with an overhead stream from the NRU column; a second portion is cooled through heat exchange with a first portion of the NRU column bottoms stream after passing through the NRU column reboiler, then an internal reflux condenser in the NRU column, and then back through the reboiler; and a third portion is cooled through heat exchange with a second portion of a bottoms stream from the NRU column. The first, second and third portions of the feed stream are recombined and the recombined stream passes through a JT valve prior to feeding into the NRU column as a liquid and vapor mixed phase stream between −60 and −150° F. and around 315 psia. The fourth portion of the feed stream is cooled through two separate heat exchanges, each with a side stream withdrawn from and returned to the NRU column, before passing through a JT valve and feeding into the NRU column as a liquid and vapor mixed stream between −200 and −250° F. and around 315 psia. The fourth portion of the feed stream feeds into the NRU column at a location that is several trays above the recombined first, second, and third portions. The overhead stream from the single column NRU is the nitrogen vent stream. The NRU bottoms stream is split into the first and second portions, each of which is processed differently to achieve the desired heat exchange with other process streams. The different processing of the two portions of the NRU bottoms stream results in two sales gas streams, one at a pressure of around 20 psia and the other at a pressure around 300 psia. Such a single tower system producing only two sales gas streams, the horsepower per inlet MMSCF generally runs around 100 to 110 HP/MMSCF.

Compared to two column systems, these single column systems have the advantage of reduced capital expenditures on equipment, including elimination of the second column, and reduced operating expenditures because no external refrigeration equipment is necessary. However, they can also have higher operating expenditures related to energy/horsepower requirements. Many single column systems have horsepower requirements of around 110 HP/MMSCF of inlet feed, particularly for such systems with a single sales gas stream from the NRU column. The HP/MMSCF is improved with prior art single column systems that produce three sales gas streams at differing pressures, typically requiring between 80 and 90 HP/MMSCF. Similarly, prior art conventional two column systems producing a single sales gas stream (such as the '544 patent), the horsepower requirements generally run around 80 to 90 HP/MMSCF of inlet feed. In addition to capital and operating expenditures, many prior NRU systems have limitations associated with processing NRU feed streams containing high concentrations of carbon dioxide. Nitrogen rejection processes involve cryogenic temperatures, which may result in carbon dioxide freezing in certain stages of the process causing blockage of process flow and process disruption. Carbon dioxide is typically removed by conventional methods from the NRU feed stream, to a maximum of approximately 35 parts per million (ppm) carbon dioxide, to avoid these issues. There is a need for a system and method to efficiently separate nitrogen from methane and other components in natural gas streams with reduced energy/horsepower requirements and preferably with the capability to process feed streams with higher concentrations of carbon dioxide.

SUMMARY OF THE INVENTION

The systems and methods disclosed herein facilitate the economically efficient removal of nitrogen from methane with substantially reduced energy/horsepower requirements. The systems and methods are particularly suitable for feed gas flow rates of around 20 MMSCFD or more and having nitrogen contents ranging from 5 mol % to 50 mol %. The systems and methods are also capable of processing feed gas containing concentrations of carbon dioxide up to approximately 100 ppm for typical nitrogen levels between 5-50%. The systems and methods have horsepower requirements that are around 50-60% of the horsepower requirements for most prior art single column NRU systems with a single sales gas stream.

According to one preferred embodiment of the invention, a system and method are disclosed for processing an NRU feed gas stream containing primarily nitrogen and methane through two fractionating columns to produce three processed sales gas streams, each at a different pressure, which may be further compressed as needed to be meet transporting pipeline requirements (typically around 615 psia). Most preferably, one sales gas stream is a high pressure stream having a pressure between 315-465 psia (more preferably between 365-415 psia), a second sales gas stream is an intermediate pressure stream having a pressure between 75-215 psia (more preferably between 115-215 psia), and a third sales gas stream is a low pressure stream having a pressure between 45-115 psia (more preferably between 50-115 psia). An inlet feed stream is preferably separated in a first separator into an overhead stream that feeds into a first stage column and a bottoms liquid stream that may be sent for further processing to recover remaining methane and NGL components. The first stage column is designed as a high pressure NRU column to remove the bulk of the incoming nitrogen from the methane and heavier hydrocarbon components, while the second stage column is operated at a lower pressure. The feed streams to the first stage NRU column and the first stage overhead stream are not cooled to traditional targeted temperatures of −200 to −245 degrees F. This allows the preferred systems and methods of the invention to feed the first column at a warmer temperature than prior art systems, which increases $CO_2$ tolerance in the feed stream. The first column also operates at a higher pressure (preferably around 315-415 psia) compared to prior art systems. The second column operates at a lower pressure (preferably around 65-115 psia).

According to another preferred embodiment, a bottoms stream from the first column is split into at least three portions. A first portion is the high pressure sales gas stream, a second portion is the intermediate pressure sales gas stream, and a third portion is at least part of the low pressure sales gas stream. Most preferably, each of the first, second, and third portions are expanded and cooled to varying degrees.

According to another preferred embodiment, the feed stream is preferably cooled in a first heat exchanger prior to feeding the first separator through heat exchange with the first separator bottoms stream, the first, second, and third portions of the first column bottoms stream, the second separator bottoms stream (which is preferably mixed with the third portion of the first column bottoms stream upstream of the first heat exchanger), and the second column overhead stream. According to another preferred embodiment, the first separator overhead stream is split into two portions, a first portion of which is recycled back through the first heat exchanger to be further cooled prior to feeding the first column. A second portion is cooled and provides reboil heat to a reboiler for the first column prior to feeding the first column. According to another preferred embodiment, the first portion of the first separator overhead stream feeds into an upper tray of the first column as a liquid with a lower temperature and lower pressure than the second portion of the first separator overhead stream that feeds into a mid-level tray of the first column, preferably as a mixed liquid-vapor stream.

According to another preferred embodiment, a bottoms stream from the second column is routed through a second heat exchanger where a specific amount of heat is added created a vapor phase. The resulting vapor and liquid are separated in a second separator. Preferably, an overhead stream from the second separator feeds back into the bottom of the second column as an ascending vapor stream. Preferably, a bottoms stream from the second separator is mixed with the third portion of the first column bottoms stream to form the low pressure sales gas stream. According to yet another preferred embodiment, the second separator bottoms stream is warmed in a second heat exchanger prior to being mixed with the third portion of the first column bottoms stream. Most preferably, the second separator is located near grade elevation level to allow for instrumentation critical for optimal operation and for maintenance to be easily accessible.

According to another preferred embodiment, which is particularly beneficial when used with feed streams having around 20% or more nitrogen, the system and method comprises one or more of the following components, configurations, or steps, most preferably each of the following components, configurations, or steps:

(1) The first column bottoms stream is split into four portions and the fourth portion is mixed with the second column bottoms stream upstream of the second separator and the mixed stream is separated in the second separator into the second separator overhead stream and the second separator bottoms stream.

(2) The second separator bottoms stream is warmed in the second heat exchanger through heat exchange with the first column overhead stream and the second column overhead stream.

(3) The pressure differential between the two columns allows for efficient energy sharing between the columns, including through heat exchange between first and second column streams to provide reflux to the first column and reboil heat to the second column. Most preferably a shell and tube style heat exchanger is used, which provides the same function as an internal knockback condenser, but with the flexibility of two independent pieces of equipment, to provide reflux to the top of the first stage column and reboil heat to the bottom of the second stage column. A stream from a top of the first column feeds into a tube side of the heat exchanger, with a liquid portion returning to the column and a vapor portion exiting the column as the first column overhead stream. Most preferably, the second column bottoms stream is split into two portions, a first portion of the second column bottoms stream is the refrigerant that enters the shell side of the heat exchanger, where it is warmed to a vapor stream that is then mixed with a second portion of the second column liquid bottoms stream (and preferably, the fourth portion of the first column bottoms stream) prior to feeding into the second separator. The second separator overhead stream feeds back into the second column as an ascending vapor stream. According to one preferred embodiment, the two columns are erected independently, most preferably with at least part of the second column being located at an elevation higher than the first column and the heat exchanger being at least partially elevated relative to the first column so that the portion of the second column bottoms stream may feed into the shell side of the heat exchanger by gravity feed. According to another preferred embodiment, the first and second stage columns may be stacked with the second column above the first column, effectively into a single column, as will be understood by those of ordinary skill in the art. According to another preferred embodiment, the two columns may be erected inside a cold box, but a cold box is not required.

(4) The first column overhead stream is cooled upstream of feeding the second column in a second heat exchanger through heat exchange with the second separator bottoms stream and the second column overhead stream.

(5) The cooled first column overhead stream passes through a third separator or flash drum downstream of the second heat exchanger to allow a desired amount of vapor from the cooled first column overhead stream to pass through a third heat exchanger to further cool the stream and condense it prior to feeding a top of the second column. This additional cooling results from heat exchange with the second column overhead stream in the third heat exchanger. Preferably, the amount of vapor withdrawn from the third separator is controlled to achieve the desired heat balance in the third heat exchanger. Most preferably, the remaining vapor from the cooled first column overhead stream exits the third separator and is combined with the liquid portion of the stream exiting the third separator to feed into a middle section of the second column.

(6) The second column overhead stream is the nitrogen vent stream and is warmed in the third heat exchanger through heat exchange with the third separator overhead stream. The second column overhead stream is preferably then warmed again (downstream of the third heat exchanger) in the second heat exchanger through heat exchange with the second separator bottoms stream and first column overhead stream. The second column overhead stream is then preferably then warmed again (downstream of the second heat exchanger) in the first heat exchanger.

According to another preferred embodiment, which is particularly beneficial when used with feed streams having around 20% or less nitrogen, the system and method comprises one or more of the following components, configurations, or steps, most preferably each of the following components, configurations, or steps:

(1) The first column bottoms stream is preferably split into three portions, none of which feed into the second separator. Only the second column bottoms stream feeds into the second separator.

(2) The second separator bottoms stream is warmed in a second heat exchanger through heat exchange with the second column bottoms stream (upstream of feeding the second separator) and the first portion of the first column overhead stream.

(3) There is preferably a shell and tube style heat exchanger used to provide reflux to the first column, but the refrigerant is provided by a third portion of the first column bottoms stream (not the second column bottoms stream as in other preferred embodiments). A stream from a top of the first column feeds into a tube side of the heat exchanger, with a liquid portion returning to the column and a vapor portion exiting the column as the first column overhead stream. A third portion of the first column bottoms stream (refrigerant) feeds into the shell side of the heat exchanger where it is warmed and then combined with a bottoms stream from the second separator to form the low pressure sales gas stream. By controlling the amount of refrigerant that feeds into the shell side of the heat exchanger, effective control of the concentration of nitrogen exiting the first column overhead stream (and subsequently feeding into the second column) is achieved, which in turn aids in controlling the amount of methane exiting the second column overhead stream (which becomes the nitrogen vent stream). The effectiveness of the second column largely depends on the nitrogen content feeding the second column and the reflux provided to the second column (discussed further below).

(4) The first column overhead stream is split into two portions prior to feeding into the second column. According to this preferred embodiment, a third separator or flash drum is not needed for the first column overhead stream. Preferably, a first portion is cooled in a second heat exchanger through heat exchange with the second separator bottoms stream and the with the second column bottoms stream (upstream of feeding the second separator). The cooled first portion preferably feeds into a mid-level tray of the second column.

(5) Preferably, a second portion of the first column overhead stream is subcooled in a third heat exchanger through heat exchange with the second column overhead stream. The second portion preferably feeds into a top level tray of the second column as a liquid, providing reflux to the second column. The second column overhead stream is also preferably cooled upstream of the third heat exchanger through a valve or an expander. Again, the effectiveness of the second column largely depends on the nitrogen content feeding the second column, with a higher nitrogen content resulting in more reflux provided to the second column, which achieves a "cleaner" second column overhead stream (having more nitrogen and less methane). The combination of the heat exchanger to provide first column reflux described in (3) above, the cooling of the second column overhead stream in the control valve/expander and the associated third heat exchanger, achieves improvements in reducing the amount of methane in the second column overhead stream in this preferred embodiment. When the nitrogen feeding into the second column is higher, the amount of cooling from the valve/expander and third heat exchanger combination (the valve/expander cools the second overhead stream, which then subcools a portion of the first column overhead stream feeding into a top of the second column in the third heat exchanger) is higher relative to the amount of heat added in the second heat exchanger (effectively acting as a reboiler for the second column), which results in more reflux to the second column and a "cleaner" overhead nitrogen vent stream.

(6) The second column overhead stream is the nitrogen vent stream and is warmed in the third heat exchanger through heat exchange with the second portion of the first column overhead stream. The second column overhead stream is then warmed again (downstream of the third heat exchanger) in the first heat exchanger and preferably does not pass through the second heat exchanger.

The primary advantage of the preferred embodiments of the systems and methods disclosed herein is substantially reduced energy/horsepower requirements compared to prior art single column systems. By splitting a bottoms stream from the first column into three separate sales gas streams, each at a different pressure, with the low pressure stream preferably between 45 to 115 psia, preferred embodiments of the system and method can achieve a substantial reduction in energy/horsepower requirements to around 55 to 75 HP/MMSCF of inlet feed. Many single column prior art systems having a single sales gas stream exiting the NRU column or even two sales gas streams have horsepower requirements of around 110 HP/MMSCF of inlet feed. The horsepower requirements are reduced in many prior art conventional two column systems producing a single gas stream to around 80 to 90 HP/MMSCF of inlet feed. The horsepower requirements are similarly reduced in many prior art single column systems that produce three sales gas streams at differing pressures to around 80 to 90 HP/MMSCF of inlet feed. However, a further reduction to around 55 to 75 HP/MMSCF of inlet feed is achievable according to preferred embodiments of the systems and methods of the invention.

For inlet feed conditions like those in the computer simulation Example 1 described below, a prior art single column design with the NRU bottoms stream split into two streams at different pressures (like in the '422 patent) would require around 11,000 hp (or around 110 hp per inlet feed MMSCF of gas); however, a preferred embodiment of the invention as shown in FIG. 1 or FIG. 2 can process that inlet gas feed stream using only 6,650 hp—a difference of more than 4,350 hp. These differences equate to around $4,300,000 in installed cost plus the added fuel demand and lower associated emissions that are saved using a preferred embodiment of the invention over prior art single column designs. The operating cost savings over the capital cost differential between a prior art single column and two column system according to a preferred embodiment of the invention as shown in FIG. 1 or FIG. 2 would be around 25% of the total installed costs. One of the aspects that results in the lower energy/horsepower requirements is the availability of three sales gas streams, each at a different pressure level, exiting the NRU first column. The pressure levels of the three streams is higher than prior art systems that split the NRU column bottoms stream into two or three sales streams. For example, in U.S. Pat. No. 9,816,752 the NRU column bottoms stream is split into three streams—a low pressure sales stream at around 15 psia, an intermediate pressure sales stream at around 111-132 psia, and a high pressure sales stream at around 248-271 psia and requires more HP/MMSCF of inlet feed than preferred embodiments of the systems and methods herein where the pressures of the three sales streams (particularly the low pressure sale stream) are higher. For example, a low pressure sales stream according to the invention may have a pressure of around 55 psia (as in Example 1) or 70 psia (as in Example 2) compared to around 15 psia in the 752 patent. Although this does not seem like a large pressure difference, there is a significant difference in HP required to compress any given volume with this higher pressure. When multiple sales gas streams are produced at different pressures, they typically undergo multiple stages of compression where a lower pressure stream is compressed in a first stage and then combined with a higher pressure stream, the combined stream is then compressed in a second stage, etc. until all of the sales gas streams are recombined into a single, final sales gas stream at the desired pressure (typically around 800 psig for pipeline requirements). Most preferably, systems and methods according to the invention will allow the use of at least one less stage of compression to achieve the desired end pressure for the final sales gas stream, resulting in a substantial energy/horsepower reduction.

BRIEF DESCRIPTION OF THE DRAWINGS

The systems and methods of the invention are further described and explained in relation to the following drawings wherein.

DESCRIPTION OF THE PREFERRED EMBODIMENTS

Figure 1:
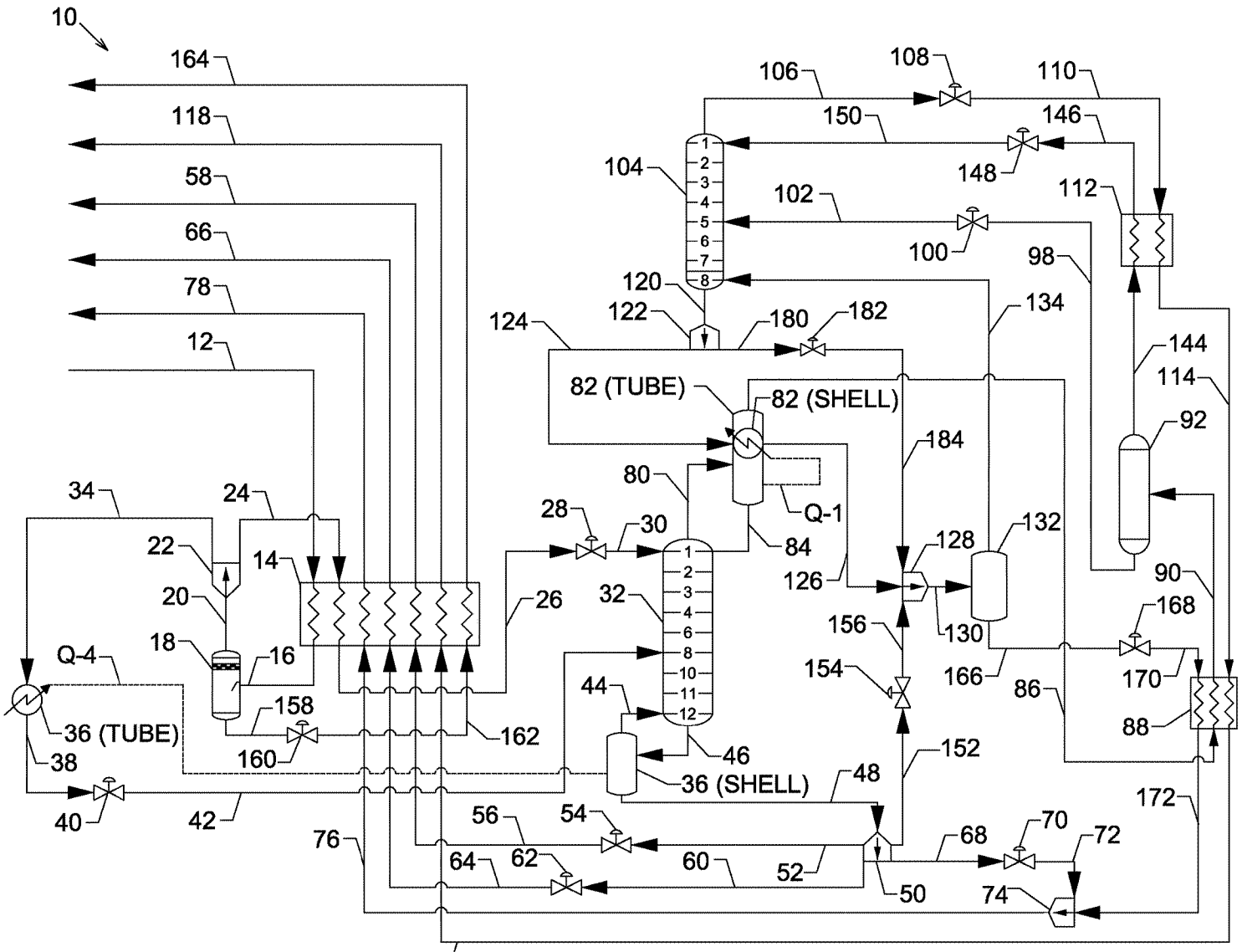
FIG. 1 is a process flow diagram illustrating a preferred embodiment of a methane and nitrogen separation system and method according to the invention.
Figure 2:
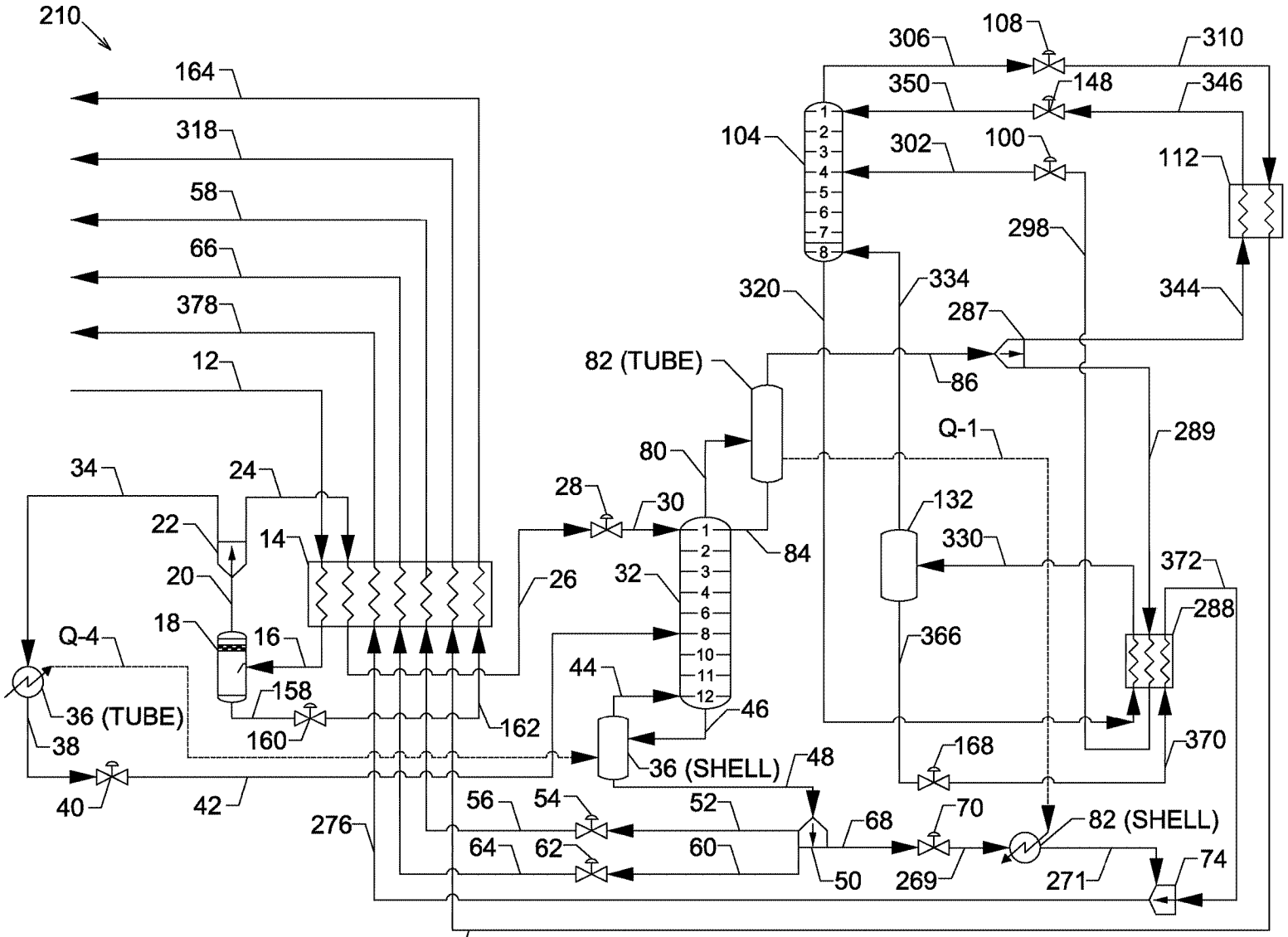
FIG. 2 is a process flow diagram illustrating another preferred embodiment of a methane and nitrogen separation system and method according to the invention.

Referring to FIG. 1, system 10 for separating nitrogen from methane from an NRU feed stream 12 according to one preferred embodiment of the invention is depicted. Referring to FIG. 2, system 210 for separating nitrogen from methane from an NRU feed stream 12 according to another preferred embodiment of the invention is depicted. System 210 is very similar to system 10 for process streams and equipment up to the point of feeding into first fractionating column 32, but differs from system 10 with processing of the overhead and bottoms streams from the first and second fractionating columns, as further described below. Where present, it is generally preferable for purposes of the present invention to remove as much of the water vapor and other contaminants from the NRU feed gas 12 as is reasonably possible prior to processing stream 12 through system 10 or system 210. It may also be desirable to remove excess amounts of carbon dioxide prior to separating the nitrogen and methane; however, the method and system are capable of processing NRU feed streams containing in excess of 100 ppm carbon dioxide without encountering the freeze-out problems associated with prior systems and methods. Methods for removing water vapor, carbon dioxide, and other contaminants are generally known to those of ordinary skill in the art and are not described herein.

In both systems 10 and 210, NRU feed stream 12 preferably comprises around 5-50% nitrogen, more preferably around 5-40% nitrogen and is at a temperature between 50-120 F, more preferably between 80-100 F, and a pressure of 450-1015 psia. Most preferably, system 10 is used when NRU feed stream 12 contains in excess of 25% nitrogen system 210 is used when NRU feed stream 12 contains less than around 20% nitrogen. Although either system 10 or 210 may be used when NRU feed stream 12 contains around 20-25% nitrogen, it is preferred to use system 210 with such feed stream nitrogen content. Feed stream 12 is preferably cooled in a first heat exchanger 14 to a temperature between 0 to −75° F. before feeding into a first separator 18 as stream 16. If stream 12 contains hydrocarbon components such that cooling to a temperature of between 0 and −75 deg F. will cause condensation of the heavier hydrocarbon components then a bottoms liquid stream 158 from first separator 18 is warmed in first heat exchanger 14 and is then sent for further processing as stream 164 to refine contained NGL components. An overhead vapor stream 20 from first separator 18 is split into streams 24 and 34. Stream 24 is recycled back through first heat exchanger 14 where it is cooled and condensed prior to passing through a JT valve 28 and then feeding into an upper level of first fractionating column 32 as liquid stream 30. Stream 34 passes through a tube side of a reboiler 36 for the first column 32 where it is cooled and partially condensed before passing through valve 40 (most preferably a throttle valve) and then feeding into a mid-to-lower level of first fractionating column 32 as mixed liquid-vapor stream 42. First column 32 is preferably operated at pressures ranging from 315-415 psia, more preferably from 325-385 psia with feed stream (streams 30 and 42) temperatures ranging from −210 to −170 F, more preferably −205 to −175 F.

In both systems 10 and 210, a liquid stream 46 from a bottom of first column 32 passes through a shell side of reboiler 36 with a vapor portion 44 returning to the bottom of column 32 and a liquid portion 48 exiting as a first column bottoms stream. Bottoms stream 48 preferably comprises around 1-4% nitrogen, more preferably 2-3% nitrogen. A vapor stream 80 from a top of first column 32 passes through a tube side 82 (tube) of a heat exchanger 82, where it is partially condensed, with a vapor portion exiting as first fractionating column overhead stream 86 and a liquid portion 84 returning to column 32. The refrigerant source for heat exchanger 82 in system 10 differs from that in system 210, as further described below. First fractionating column overhead stream 86 preferably comprises around 15-40% methane and 60-85% nitrogen.

Referring to FIG. 1, in system 10, bottoms stream 48 is preferably split into four portions: 52 (first portion), 60 (second portion), 68 (third portion), and 152 (fourth portion) in splitter 50. Each portion passes through a valve 54, 62, 70, 154 where it is partially vaporized, reducing the temperature and pressure of the exiting streams 56 (first portion), 64 (second portion), 72 (third portion), and 156 (fourth portion) to varying degrees.

In system 10, stream 56 preferably has a pressure of 325-385 psia and a temperature of −145 to −165° F. before being warmed in first heat exchanger 14 to become a high pressure sales gas stream 58. Stream 64 preferably has a pressure of 150-175 psia and a temperature of −175 to −200° F. before being warmed in first heat exchanger 14 to become an intermediate pressure sales gas stream 66. In system 10, stream 72 preferably has a pressure of 45-105 psia and a temperature of −200 to −235° F. before being mixed in mixer 74 with a bottoms stream from second separator 132 to form stream 76. Stream 76 preferably has a pressure of 45-105 psia and a temperature of −200 to −235° F. before being warmed in first heat exchanger 14 to become a low pressure sales gas stream 78.

Most preferably, in system 10, high pressure sales gas stream 58 is at a pressure between 315-415 psia, and is at a pressure higher than intermediate sales gas stream 66 and higher than low pressure sales gas stream 78. Most preferably, intermediate pressure sales gas stream 66 is at a pressure between 145-215 psia, and is at a pressure lower than high sales gas stream 58 and higher than low pressure sales gas stream 78. Most preferably, low pressure sales gas stream 78 is at a pressure between 45-105 psia, and is at a pressure lower than intermediate sales gas stream 66 and lower than high pressure sales gas stream 58. The pressures of high pressure sales gas stream 58 and lower pressure sales gas stream 78 are substantially higher than prior art systems, such as U.S. Pat. No. 9,816,752, where the bottoms stream from the NRU column is separated into multiple streams at different pressures. The pressures of the high pressure sales gas stream 58 and intermediate sales gas stream 66 are also substantially higher than other prior art systems having only a single sales gas stream from the bottoms of the NRU column, such as U.S. Pat. No. 5,141,544. Each sales gas stream preferably comprises at no more than 4% nitrogen.

In system 10, first column overhead stream 86 is cooled and partially condensed in a second heat exchanger 88, before entering a third separator or flash drum 92 as stream 90. Cooled first column overhead stream 90 is separated in third separator 92 into a primarily liquid bottoms portion 98 and a vapor overhead portion 144. The amount of vapor exiting the third separator 92 is controlled by the amount of vapor needed to achieve certain thermal conditions as dictated by the requirements of the heat exchanger 112. Specifically, the amount of vapor entering the third exchanger 112 is determined by the difference in temperature between streams 144 and 114 so that stream 114 preferably exits the third heat exchanger 112 at temperature approximately 2 to 5° F. colder than stream 144. The excess vapor, not required by the heat exchanger 112, exits the third separator 92 from the bottom of the separator with the exiting liquid as stream 98. Vapor stream 144 is then cooled and condensed in the third heat exchanger 112 prior to feeding into a top of the second column 104 as a liquid reflux stream 150. Third separator 92 is designed to allow a measured amount of vapor flow from the cooled first column overhead stream 90, to pass through third heat exchanger 112 to control subcooling stream 144 prior to feeding into the top of the second column 104 as stream 150. The amount of subcooling achieved in the third exchanger 112 is preferably approximately 40 to 80° F. This subcooling is required to cool the overhead of the second tower, stage 1, to an adequately low temperature to create reflux inside of the second tower 104. This reflux is required to achieve a high degree of methane/nitrogen separation within the second tower 104 and to achieve a preferred purity of nitrogen exiting the second tower 104 of approximately 96-99%, most preferably at least approximately 98%. The balance of the vapor present in stream 90 and not utilized by the exchanger 112 exits the third separator along with the liquid present in stream 90 as stream 98. The two phase stream 98 then enters the expansion valve 100 where the pressure and temperature are preferably reduced 55-75 psia, more preferably around 70 psia, and a temperature of −265 to −285° F., more preferably around −275° F. respectively.

In system 10, second column 104 is preferably operated at pressures ranging from 50-115 psia, more preferably from 55-75 psia with feed stream (streams 150, 102, 134). The approximate feed temperature of stream 150 feeding the top of the second tower is approximately −295° F. The temperature feeding the intermediate feed, mid column is approximately −275° F. and the temperature feeding the column bottom is approximately −225° F. The subcooled liquid stream 150 entering the column top into tray 1 provides the required reflux for the column and the vapor entering as stream 134 provides the reflux vapor. An overhead stream 106 from the second column 104 is routed to an expansion valve 108 where the temperature and pressure are further reduced. The approximate temperature at this point is preferably −290 to −310° F., most preferably approximately −300° F. The vapor exiting the expansion valve 108 is then warmed in third heat exchanger 112, then warmed again in second heat exchanger 88, then warmed again in the first heat exchanger 14 before exiting system 10 as nitrogen vent stream 118. Nitrogen vent stream 118 preferably comprises less than 2% methane and more than 98% nitrogen.

In system 10, a liquid bottoms stream 120 from second column 104 is split in splitter 122 into two portions 124 and 180 that are later recombined, along with a fourth portion of the bottoms stream from first column 32, in mixer 128 to form stream 130, which feeds into second separator 132. A first portion of the bottoms stream from column 104, stream 124, is a refrigerant source for heat exchanger 82, being warmed in a shell side of heat exchanger 82 upstream of mixer 128. A second portion of the bottoms stream from column 104, stream 180, enters temperature control valve 182 upstream of mixer 128. The placement of this control valve 182, and the piping configuration involving streams 124, 180, 184, and 126, are important aspects to operation of system 10 in that it provides the pressure drop necessary to offset the pressure loss through the shell side of heat exchanger 82.

Stream 130 in system 10 preferably feeds into second separator 132 at a temperature −220 to −235° F. and a pressure between 50-75 psia. An additional two phase stream 156 (a partially vaporized fourth portion of the first column bottoms stream, preferably at a temperature of −220 to −210° F. and a pressure between 50-115 psia) is added to separator 132 to provide additional refrigeration as required to allow exchanger 88 to function properly. Stream 156 is preferably mixed with two portions of the bottoms stream from second column 104 in mixer 128 to form stream 130 prior to feeding into second separator 132. A vapor stream 134 exits the separator 132 and is then routed to the second column 104. Likewise, a liquid stream 166, preferably comprising less than 4% nitrogen and more preferably less than 2% nitrogen, exits the separator 132. Second column 104 preferably does not comprise a reboiler, but uses heat exchanger 82 and second separator 132 to effectively act as a reboiler with stream 134 being returned to a bottom of column 104 as an ascending vapor stream. Bottoms stream 166 from second separator 132 is then routed to level valve 168 as required to hold a desired liquid level in the separator 132. Stream 166 exits the level valve 168 as stream 170 where it then enters heat exchanger 88. Stream 170 is warmed in second heat exchanger 88 before mixing in mixer 74 with a third portion 72 of the bottoms stream from first column 32 to form low pressure sales gas stream 78.

System 10 utilizes efficient heat exchange between various process streams to improve process performance. In first heat exchanger 14, feed stream 12 and a portion 24 of an overhead stream from first separator 18 are cooled through heat exchange with first portion 56 of the first column bottoms stream, second portion 64 of the first column bottoms stream, mixed stream 76, overhead stream 116 from the second column 104 (downstream of heat exchange in second heat exchanger 88 and third heat exchanger 112) and a bottoms stream 162 from the first separator 18. The feed stream 12 is cooled in first heat exchanger 14 upstream of feeding first separator 18. The purpose of separator 18 is to provide separation of heavier hydrocarbon components such as propane, butanes and gasolines from the inlet feed stream 12 before entering the colder part of the system 10. Portion 24 is cooled in first heat exchanger 14 upstream of routing the stream to the first column 32. In second heat exchanger 88, overhead stream 86 from first column 32 is cooled through heat exchange with overhead stream 114 from second column 104 (downstream of heat exchanger in third heat exchanger 112) and bottoms stream 170 from second separator 132. Overhead stream 86 is cooled in second heat exchanger 88 prior to feeding third separator 92. In third heat exchanger 112, stream 144 from third separator 92 is subcooled through heat exchange with overhead stream 110 from second column 104. System 10 also preferably allows for heat exchange between a second portion 34 of the overhead stream from the first separator 18 and a liquid stream 46 from a bottom of column 32 in a reboiler 36. The exchanger 36 (tube) is the tube side of a shell and tube style heat exchanger used to provide the necessary heat source for the bottom of the first column 32. The exchanger depicted as 36 (shell) is the shell side of the exchanger 36.

System 10 preferably also comprises a fourth heat exchanger comprising a tube side 82 (tube) and a shell side 82 (shell), that are independent pieces of equipment configured as a vertical tube, falling film condenser. Heat exchanger 82 (tube) and 82 (shell) provide the similar function as an internal knockback condenser (like that described in U.S. Patent Application Publication 2007/0180855, incorporated herein by reference). A vapor stream 80 from a top of first column 32 passes through a tube side 82 (tube) of a heat exchanger 82 (tube), where it is partially condensed, with a vapor portion exiting as first fractionating column overhead stream 86 and a liquid portion 84 returning to column 32. The refrigerant source for heat exchanger 82 is a first portion of the bottom fluid from the second column 104, which is routed to the shell side of the exchanger 82, and the condensed liquid from first column overhead stream is designed to operate on the tube side of exchanger 82. The first portion 124 of the bottoms stream from second column 104 passes through the shell side 82 (shell), preferably by gravity feed, where heat is added resulting in a partial or total vaporization of stream 124 and exiting the exchanger 82 (shell) as stream 126. Stream 126 is then mixed with the liquid second portion of the bottoms stream from the second column 104 to form stream 130, which feeds into second separator 132. Column 104 is preferably located in an elevated position relative to column 32, and the two may be stacked together to effectively form a single column, with elevated heat exchanger 82 preferably mounted between column 104 and column 32 and at least partially elevated relative to column 32. This allows gravity feed of the liquid from stream 124 through the shell side 82 (shell) of the fourth heat exchanger, like in a knockback condenser, so that it is not necessary to use a conventional reflux condenser that requires a pump to circulate the refrigerant liquid, which can add undesirable heat to the liquid. Utilizing fourth heat exchanger 82 allows system 10 to operate with less refrigerant (horsepower) resulting in lower cost and greater flexibility. This fourth heat exchanger provides reflux to column 32 and, coupled with second separator 132, reboil heat to column 104. Although it is known in the prior art to use a knockback condenser, the configuration of heat exchanger 82 (shell) and 82 (tube) and the pressures and temperatures used in system 10 are different from the prior art. In the prior art, the knock back condenser had a single purpose, which is to remove heat from the column 32 overhead. In the configuration of exchanger 82 in system 10, the purpose is twofold. As with the prior art, the exchanger 82 is still utilized to provide the removal of heat from the overhead of column 32, but the primary purpose of exchanger 82 in system 10 is to provide a heat source to reboil the second column 104. In operation, the controls are adjusted to provide for the second column heat and are not designed to remove heat from the first column 32 against a specific target. The pressure difference between the two columns allows for this interchange of heat. The piping configuration to allow satisfactory operation of this exchanger 82 is an important aspect of system 10 must be designed so as to allow for the correct amount of heat input into stream 124.

Referring to FIG. 2, in system 210, bottoms stream 48 is preferably split into three portions 52 (first portion), 60 (second portion), and 68 (third portion) in splitter 50. Each portion passes through a valve 54, 62, 70 where it is partially vaporized, reducing the temperature and pressure of the exiting streams 56 (first portion), 64 (second portion), and 269 (third portion) to varying degrees. Bottoms stream 48 preferably comprises around 1-4% nitrogen, more preferably 2-3% nitrogen. Stream 56 preferably has a pressure of 325-415 psia and a temperature of −145 to −165° F. before being warmed in first heat exchanger 14 to become a high pressure sales gas stream 58. Stream 64 preferably has a pressure of 150-200 psia and a temperature of −175 to −200°

F. before being warmed in first heat exchanger 14 to become an intermediate pressure sales gas stream 66. Stream 269 preferably has a pressure of 55 to 115 psia and a temperature of −200 to −225° F. and is the refrigerant source for heat exchanger 82. Stream 269 is warmed in a shell side of heat exchanger 82 (shell), exiting as stream 271, which is then mixed in mixer 74 with a bottoms stream from second separator 132 to form stream 276. Stream 276 preferably has a pressure of 65 to 115 psia before being warmed in first heat exchanger 14 to become a low pressure sales gas stream 378.

Most preferably, as with system 10, high pressure sales gas stream 58 in system 210 is at a pressure between 315-465 psia (more preferably 365-415 psia), and is at a pressure higher than intermediate sales gas stream 66 and is at a pressure higher than the intermediate sale gas stream 66 and higher than low pressure sales gas stream 378. Most preferably, intermediate pressure sales gas stream 66 in system 210 is at a pressure between 75-215 psia (more preferably 145-215 psia), and is at a pressure lower than high sales gas stream 58 and higher than low pressure sales gas stream 378. Most preferably, low pressure sales gas stream 378 in system 210 is at a pressure between 45-115 psia (more preferably 50-115 psia), and is at a pressure lower than intermediate sales gas stream 66 and lower than high pressure sales gas stream 58. The pressures of high pressure sales gas stream 58 and lower pressure sales gas stream 378 are substantially higher than prior art systems, such as U.S. Pat. No. 9,816,752, where the bottoms stream from the NRU column is separated into multiple streams at different pressures. Additionally, the pressure of low pressure sales gas stream 378 in system 210 is generally higher than low pressure sales gas stream 78 in system 10. The pressures of the high pressure sales gas stream 58 and intermediate sales gas stream 66 are also substantially higher than other prior art systems having only a single sales gas stream from the bottoms of the NRU column, such as U.S. Pat. No. 5,141,544. Each sales gas stream in system 210 preferably comprises at no more than 4% nitrogen.

In system 210, first fractionating column overhead stream 86 preferably comprises around 15-40% methane and 60-85% nitrogen. First column overhead stream 86 is split into streams 344 and 289 in splitter 287. Stream 289 is cooled and condensed in a second heat exchanger 288, before passing through expansion valve 100, exiting as mixed liquid-vapor stream 302 with a pressure preferably reduced to around 55 to 115 psia and a temperature reduced to around −265 to −300° F. Second heat exchanger 288 in system 210 is different from second heat exchanger 88 in system 10 in the number of streams absorbing heat and rejecting heat. In system 10, two of the three stream passing through second heat exchanger 88 are absorbing heat and only one is rejecting heat. In system 210, two of the three streams passing through heat exchanger 288 are rejecting heat and only one is absorbing heat. Stream 302 then feeds into a mid-level of second fractionating column 104. Stream 344 is cooled and condensed in third heat exchanger 112, exiting as stream 346. Stream 346 which passes through valve 148, reducing the pressure to become mixed liquid-vapor stream 350 prior to feeding into an upper tray level of second fractionating column 104. In the configuration of system 210, a third separator or flash drum 92 used in system 10 is not needed for overhead stream 86, saving on equipment costs. The amount of subcooling of stream 344 to stream 346 achieved in the third exchanger 112 is preferably approximately 40 to 80° F. As in system 10, this subcooling is required in system 210 to cool the overhead of the second tower, stage 1, to an adequately low temperature to create reflux inside of the second tower 104. This reflux is required to achieve a high degree of methane/nitrogen separation within the second tower 104 and to achieve a preferred purity of nitrogen exiting the second tower 104 of approximately 96-99%, most preferably at least approximately 98%. A third stream 334 also feeds into a bottom of second fractionating column 104, as further described below.

In system 210, second column 104 is preferably operated at pressures ranging from 50-115 psia, more preferably from 55-75 psia with feed stream (streams 350, 302, 334). The approximate feed temperature of stream 350 feeding the top of the second tower is approximately −295° F. The temperature of stream 302 feeding the intermediate feed, mid column is approximately −285° F. and the temperature of stream 334 feeding the column bottom is approximately −236° F. The subcooled liquid stream 350 entering the column top into tray 1 provides the required reflux for the column and the vapor entering as stream 334 provides the reboiler vapor. An overhead stream 306 from the second column 104 is routed to an expansion valve 108 where the temperature and pressure are further reduced. The approximate temperature at this point is preferably −290 to −310° F., most preferably approximately −300° F. The vapor exiting the expansion valve 108 is then warmed in third heat exchanger 112 and then warmed again in the first heat exchanger 14 before exiting system 210 as nitrogen vent stream 318. Unlike system 10 (where stream 110 passes through third heat exchanger 112, then second heat exchanger 88, then first heat exchanger 14), stream 310 in system 210 only passes through third heat exchanger 112 and first heat exchanger 14. Nitrogen vent stream 318 preferably comprises less than 2% methane and more than 98% nitrogen.

A liquid bottoms stream 320 from second column 104 is warmed in second heat exchanger 288, exiting as stream 330, which feeds into second separator 132. Stream 330 preferably feeds into second separator 132 at a temperature −250 to −275° F. and a pressure between 50-115 psia. A vapor stream 334 exits the separator 132 and is then routed to the second column 104. Likewise, a liquid stream 366, preferably comprising less than 6% nitrogen and more preferably less than 4% nitrogen, exits the separator 132. The permissible nitrogen specification for the second tower is preferably more lenient than the first tower because of the relative flow rates from the bottom of each tower and in order to allow heat exchanger 288 to operate more efficiently. Second column 104 preferably does not comprise an independent reboiler, but uses a heat exchange pass in the second heat exchanger as a source of heat. The vapor generated in this (reboiler) heat exchange pass is separated in the second separator 132 providing stream 334 that is returned to a bottom of column 104 as an ascending vapor stream. Bottoms stream 366 from second separator 132 is then routed to level valve 168 as required to hold a desired liquid level in the separator 132. Stream 366 exits the level valve 168 as stream 370 where it then enters second heat exchanger 288. Stream 370 is warmed in second heat exchanger 288, exiting as stream 372, which is mixed in mixer 74 with a third portion 271 of the bottoms stream from first column 32 to form low pressure sales gas stream 378.

System 210 utilizes efficient heat exchange between various process streams to improve process performance. In first heat exchanger 14, feed stream 12 and a portion 24 of an overhead stream from first separator 18 are cooled through heat exchange with first portion 56 of the first column bottoms stream, second portion 64 of the first column bottoms stream, mixed stream 276, overhead stream 316 from the second column 104 (downstream of heat exchange in third heat exchanger 112) and a bottoms stream 162 from the first separator 18. The feed stream 12 is cooled in first heat exchanger 14 upstream of feeding first separator 18. The purpose of separator 18 is to provide separation of heavier hydrocarbon components such as propane, butanes and gasolines from the inlet feed stream 12 before entering the colder part of the system 210. Portion 24 is cooled in first heat exchanger 14 upstream of routing the stream to the first column 32. In second heat exchanger 288, a first portion of overhead stream 86 from first column 32 is cooled through heat exchange with bottoms stream 320 from second column 104 and bottoms stream 370 from second separator 132. In third heat exchanger 112, a second portion of overhead stream 86 is subcooled through heat exchange with overhead stream 310 from second column 104. System 210 also preferably allows for heat exchange between a second portion 34 of the overhead stream from the first separator 18 and a liquid stream 46 from a bottom of column 32 in heat exchanger 36. The exchanger 36 (tube) is the tube side of a shell and tube style heat exchanger used to provide the necessary heat source for the bottom of the first column 32. The exchanger depicted as 36 (shell) is the shell side of the exchanger 36.

System 210 preferably also comprises a fourth heat exchanger comprising a tube side 82 (tube) and a shell side 82 (shell), that are independent pieces of equipment configured as a vertical tube, falling film condenser. Heat exchanger 82 (tube) and 82 (shell) provide the similar function as an internal knockback condenser (like that described in U.S. Patent Application Publication 2007/0180855, incorporated herein by reference). A vapor stream 80 from a top of first column 32 passes through a tube side 82 (tube) of a heat exchanger 82 (tube), where it is partially condensed, with a vapor portion exiting as first fractionating column overhead stream 86 and a liquid portion 84 returning to column 32. The refrigerant source for heat exchanger 82 in system 210 is a third portion of the bottom fluid from the first column 32 (stream 269), which is routed to the shell side. of the exchanger 82, and the condensed liquid from first column overhead stream is designed to operate on the tube side of exchanger 82. Unlike system 10, in system 210 column 104 can be located in any position and is not limited to an elevated position related to column 32. Heat exchanger 82 is preferably mounted above (in an elevated position relative to) column 32. Since the column 104 in system 210 can be installed independently of heat exchanger 82 and column 32, there is greater flexibility with respect to the footprint required for installation of system 210 compared to system 10 and as to the overall height required for facility installation in system 210 compared to system 10. In addition, the cost of system 210 is lower than system 10 due to more conventional foundation requirements for installation.

Acceptable inlet compositions in which systems 10 and 210 may operate satisfactorily are listed in the following Table 1:

TABLE 1

INLET STREAM COMPOSITIONS

| Inlet Component | Acceptable Inlet Composition Ranges |
|---|---|
| Methane | 50-95% |
| Ethane and Heavier Components | 0-20% |
| Carbon Dioxide | 0-100 ppm |
| Nitrogen | 5-50%<br>Preferably 20% or greater for system 10 and less than 20% for system 210 |

Example 1—Computer Simulation for 100 MMSCFD Feed with 20% Nitrogen in System 10

Still referring to FIG. 1, a system 10 and method for processing a 100 MMSCFD NRU feed stream 12, comprising approximately 20 mol % nitrogen and 72 mol % methane at 120° F. and 664.5 psia based on a computer simulation is shown and described below. The nitrogen content of feed stream 12 is at the low end of the preferred nitrogen range of 20% or more for system 10, but system 10 would be expected to perform even better with higher nitrogen levels in feed stream 12. This amount of nitrogen in feed stream 12 is also used for comparison to system 210 in Example 2 below, which also has 20% nitrogen (the high end of preferred nitrogen levels for system 210).

Feed stream 12 passes through first heat exchanger 14, which preferably comprises a plate-fin heat exchanger. The feed stream emerges from the heat exchanger and enters separator 18 having been cooled to −17.4° F. as stream 16. This cooling is the result of heat exchange with other process streams 56, 64, 76, 116, and 162. The cooled stream 16 is then separated into an overhead vapor stream 20 and a bottoms liquid stream 158. Bottoms liquid stream 158 comprises around 1.8% nitrogen, 26% methane, 10% ethane, and 14% propane. The pressure of stream 158 is reduced in valve 160 to around 165 psia in mixed liquid-vapor stream 162. Stream 162 is then warmed in heat exchanger 14, exiting as stream 164 at 101.7° F. and 160 psia. Stream 164 may be sent to an NGL stabilizer column (not shown) for further processing.

Overhead vapor stream 20, comprising around 20% nitrogen and around 73% methane is split in splitter 22 into streams 24 and 34. Stream 24 is then routed for another pass through heat exchanger 14, exiting as a subcooled liquid stream 26 having been cooled to −195° F. Stream 26 passes through a pressure reducing valve 28, exiting as stream 30 with a pressure around 395 psia. Stream 30 feeds into an upper tray level on first fractionating column 32. First fractionating column 32 is preferably a high pressure column upstream of a low pressure second fractionating column 104. Vapor stream 34, the other portion of the first separator overhead stream, passes through the tube side of exchanger 36 in order to provide heat for the reboiler 36 for first fractionating column 32, exiting as mixed liquid-vapor stream 38 having been cooled to around −138° F. Around 8.04 million Btu/Hr of heat energy (Q-4) passes from tube side of reboiler 36 (tube) (from stream 34) to shell side of reboiler 36 (shell) (to stream 46). Stream 38 passes through temperature control valve 40 (preferably a throttling valve), exiting as stream 42 with a reduced pressure of around 391 psia. Mixed liquid-vapor stream 42 feeds into first fractionating column 32 near a mid-level tray location. Stream 80 comprising around 59% nitrogen and 40.5% methane at −189° F. from the top of column 32 feeds into a tube side 82 (tube) of a shell and tube heat exchanger that acts as a condenser for column 32. A liquid portion of stream 80 returns to column 32 as stream 84 and a vapor portion exits tube side 82 (tube) as overhead stream 86 comprising around 66% nitrogen and 34% methane at −199° F. and 385 psia. Around 1.86 million Btu/hr of heat energy (Q-1) passes from tube side 82 (tube) to shell side 82 (shell).

First column overhead stream 86 passes through second heat exchanger 88, which preferably comprises a plate-fin heat exchanger, exiting as cooled, mixed liquid-vapor stream 90 at −224° F. Stream 90 then enters a third separator or flash drum 92 where it is separated into liquid stream 98 and vapor stream 144. Stream 98 comprises 63% nitrogen and 37% methane at −224° F. and 379 psia. Stream 98 passes through valve 100, existing as stream 102 at −276° F. with a pressure of around 70 psia. Stream 102 feeds into a mid-level of second fractionating column 104. Vapor stream 144 passes through third heat exchanger 112, which preferably comprises a plate-fin heat exchanger, exiting as stream 146 having been subcooled to around −296° F. Stream 146 then passes through valve 148 to reduce the pressure of exiting stream 150 to around 70 psia. Stream 150 comprising around 86% nitrogen and 14% methane at −295° F. and 70 psia then feeds into an upper level of column 104. A third stream, stream 134 comprising around 20% nitrogen and 80% methane at −226° F. and 65 psia, also feeds into a lower level of column 104 as an ascending vapor stream.

Components of feed streams 150, 102, and 134 are separated in second fractionating column 104 into an overhead stream 106 and a bottoms stream 120. Overhead stream 106 comprises around 98% nitrogen and less than 2% methane at −290° F. and 62.5 psia before passing through valve 108, existing at stream 110 at −300° F. and 20 psia. Stream 110 passes through third heat exchanger 112, exiting as stream 114 warmed to −229° F. Stream 114 then passes through second heat exchanger 88, exiting as stream 116 warmed to −204° F. Stream 116 then passes through first heat exchanger 14, exiting as stream 118 warmed to 101.7° F. Stream 118 is the nitrogen vent stream for system 10.

Bottoms stream 120 comprising around 9% nitrogen and 91% methane at −246° F. and 65 psia is split in splitter 122 into streams 124 and 180. Liquid stream 124 passes through the shell side 82 (shell) of a shell and tube heat exchanger that acts as a condenser for column 32, exiting as vapor stream 126 at around −221° F. Stream 180 passes through valve 182, exiting as stream 184. Streams 184 and 126 are mixed in mixer 128 to form stream 130 that feeds into a low pressure second separator 132. Valve 182 is used to control the temperature of mixed stream 130 feeding into separator 132, by controlling a flow rate of stream 180 inversely relative to stream 124. Stream 156 is also preferably mixed in mixer 128 to form stream 130, but may also be separately fed into separator 132. Stream 130 (and 156 if separate from 130) are separated in separator 132 into overhead vapor stream 134 and bottoms liquid stream 166. Stream 134 is returned to second fractionating column 104 as an ascending vapor stream providing heat to the second column as is similar to having a reboiler in second column 104. Bottoms stream 166 comprises less than 2% nitrogen and around 96% methane at −226° F. and 65 psia. Stream 166 passes through level valve 168, exiting as stream 170 with a slight pressure reduction to 60 psia. Stream 170 passes through heat exchanger 88, exiting as stream 172 having been warmed to −204° F. Stream 172 is mixed with a partially vaporized third portion 72 of a bottoms stream from fractionating column 32 in mixer 74 to form mixed stream 76.

Liquid stream 46 from a bottom of column 32 passes through reboiler 36 (shell) where there is heat exchange with stream 34 (which is a portion of first separator overhead stream for system 10). A vapor portion 44 of stream 46 returns to the bottom of column 32 and a liquid portion exits as bottoms stream 48 comprising less than 2% nitrogen and around 89% methane at −145° F. and 388.5 psia. Bottoms stream 48 is then split in splitter 50 into streams 52, 60, 68 and 152. Stream 52 passes through valve 54, exiting as stream 56 at 345 psia. Stream 56 then passes through heat exchanger 14, exiting as stream 58 having been warmed to around 101.5° F. and at a pressure of 340 psia. Stream 58 is one of the three sales gas streams. Stream 60 passes through valve 62, exiting as stream 64 at −183° F. and a pressure of 165 psia. Stream 64 then passes through heat exchanger 14, exiting as stream 66 having been warmed to around 101.7° F. and a pressure of 160 psia. Stream 66 is a second of the sales gas streams. Stream 68 passes through valve 70, exiting as stream 72 having been cooled to −216° F. at a pressure of 65 psia. Stream 72 is mixed with stream 172 in mixer 74 to form stream 76 at −217.8° F. and 57.5 psia, which passes through heat exchanger 14 exiting as stream 78 at 101.7° F. and 55 psia. Stream 78 is a third sales gas stream. Of the sales gas streams, stream 58 is a high pressure stream (higher than streams 66 and 78) and depending on the requirements of the installation, this stream may not need further compression to enter existing facility equipment or the compression requirements would be significantly reduced when compared with existing nitrogen rejection technologies. Stream 66 is an intermediate pressure stream (lower pressure than stream 58 but higher pressure than stream 78), and stream 78 is a low pressure stream (lower pressure than streams 58 and 66). These streams 66 and 78 may be further compressed as needed to meet pipeline requirements.

Stream 152, the fourth portion split from bottoms stream 48, passes through valve 154, exiting as partially vaporized stream 156 having been cooled to −214° F. at a pressure of 70 psia. Stream 156 is the third stream to enter mixer 128. The mixed stream from 128 exits as stream 130 and feeds into second separator 132.

The specific flow rates, temperatures, pressures, and compositions of various flow streams referred to in connection with the above discussion of a computer simulation for a system 10 appear in Table 2 below. These values are based on a feed gas stream 12 comprising 20% nitrogen, around 73% methane, and 50 ppm of carbon dioxide with a flow rate of 100 MMSCFD.

TABLE 2

FLOW STREAM PROPERTIES FOR EXAMPLE 1-SYSTEM 10

| Mole Fraction/Property-Stream No. | 12 | 16 | 20 | 24 |
|---|---|---|---|---|
| Nitrogen | 20.0000* | 20.0000 | 20.1842 | 20.1842 |
| CO2 | 0.005* | 0.005 | 0.00499903 | 0.00499903 |
| Methane | 72.7672* | 72.7672 | 73.2420 | 73.2420 |
| Ethane | 4.28875* | 4.28875 | 4.22698 | 4.22698 |
| Propane | 1.64580* | 1.64580 | 1.51655 | 1.51655 |
| i-Butane | 0.313443* | 0.313443 | 0.251551 | 0.251551 |
| n-Butane | 0.616397* | 0.616397 | 0.445057 | 0.445057 |
| i-Pentane | 0.126174* | 0.126174 | 0.0640669 | 0.0640669 |
| n-Pentane | 0.103348* | 0.103348 | 0.0447387 | 0.0447387 |
| Hexane | 0.133944* | 0.133944 | 0.0198272 | 0.0198272 |
| Temperature ° F. | 120* | −17.4194 | −17.4875 | −17.4875 |
| Pressure psia | 664.5* | 659.5 | 658.5 | 658.5 |
| Mole Fraction Vapor % | 100 | 99* | 100 | 100 |
| Std Vapor Volumetric Flow MMSCFD | 100* | 100 | 98.9982 | 70.5388 |

TABLE 2-continued

FLOW STREAM PROPERTIES FOR EXAMPLE 1-SYSTEM 10

| Mole Fraction/Property-Stream No. | 26 | 30 | 34 |
|---|---|---|---|
| Nitrogen | 20.1842 | 20.1842 | 20.1842 |
| CO2 | 0.00499903 | 0.00499903 | 0.00499903 |
| Methane | 73.2420 | 73.2420 | 73.2420 |
| Ethane | 4.22698 | 4.22698 | 4.22698 |
| Propane | 1.51655 | 1.51655 | 1.51655 |
| i-Butane | 0.251551 | 0.251551 | 0.251551 |
| n-Butane | 0.445057 | 0.445057 | 0.445057 |
| i-Pentane | 0.0640669 | 0.0640669 | 0.0640669 |
| n-Pentane | 0.0447387 | 0.0447387 | 0.0447387 |
| Hexane | 0.0198272 | 0.0198272 | 0.0198272 |
| Temperature ° F. | −195* | −195.030 | −17.4875 |
| Pressure psia | 653.5 | 395* | 658.5 |
| Mole Fraction Vapor % | 0 | 0 | 100 |
| Std Vapor Volumetric Flow MMSCFD | 70.5388 | 70.5388 | 28.4594 |

| Mole Fraction/Property-Stream No. | 38 | 42 | 44 | 46 |
|---|---|---|---|---|
| Nitrogen | 20.1842 | 20.1842 | 7.76152 | 3.73593 |
| CO2 | 0.00499903 | 0.00499903 | 0.00166185 | 0.00531146 |
| Methane | 73.2420 | 73.2420 | 91.6747 | 89.7532 |
| Ethane | 4.22698 | 4.22698 | 0.527887 | 4.23647 |
| Propane | 1.51655 | 1.51655 | 0.0315056 | 1.47234 |
| i-Butane | 0.251551 | 0.251551 | 0.00111929 | 0.242955 |
| n-Butane | 0.445057 | 0.445057 | 0.00154193 | 0.429712 |
| i-Pentane | 0.0640669 | 0.0640669 | 2.12102E−05 | 0.0617961 |
| n-Pentane | 0.0447387 | 0.0447387 | 2.53333E−05 | 0.0431562 |
| Hexane | 0.0198272 | 0.0198272 | 1.62426E−06 | 0.0191229 |
| Temperature ° F. | −137.715* | −160.830 | −145.335 | −151.495 |
| Pressure psia | 653.5 | 391.273* | 388.5 | 388.5 |
| Mole Fraction Vapor % | 40.1571 | 50.8018 | 100 | 0 |
| Std Vapor Volumetric Flow MMSCFD | 28.4594 | 28.4594 | 31.6770 | 102.647 |

| Mole Fraction/Property-Stream No. | 48 | 52 | 56 |
|---|---|---|---|
| Nitrogen | 1.93913 | 1.93913 | 1.93913 |
| CO2 | 0.00694044 | 0.00694044 | 0.00694044 |
| Methane | 88.8955 | 88.8955 | 88.8955 |
| Ethane | 5.89178 | 5.89178 | 5.89178 |
| Propane | 2.11545 | 2.11545 | 2.11545 |
| i-Butane | 0.350896 | 0.350896 | 0.350896 |
| n-Butane | 0.620823 | 0.620823 | 0.620823 |
| i-Pentane | 0.0893689 | 0.0893689 | 0.0893689 |
| n-Pentane | 0.0624074 | 0.0624074 | 0.0624074 |
| Hexane | 0.0276576 | 0.0276576 | 0.0276576 |
| Temperature ° F. | −145.335 | −145.335 | −151.019 |
| Pressure psia | 388.5 | 388.5 | 345* |
| Mole Fraction Vapor % | 0 | 0 | 4.97369 |
| Std Vapor Volumetric Flow MMSCFD | 70.9699 | 42.2528 | 42.2528 |

| Mole Fraction/Property-Stream No. | 58 | 60 | 64 | 66 |
|---|---|---|---|---|
| Nitrogen | 1.93913 | 1.93913 | 1.93913 | 1.93913 |
| CO2 | 0.00694044 | 0.00694044 | 0.00694044 | 0.00694044 |
| Methane | 88.8955 | 88.8955 | 88.8955 | 88.8955 |
| Ethane | 5.89178 | 5.89178 | 5.89178 | 5.89178 |
| Propane | 2.11545 | 2.11545 | 2.11545 | 2.11545 |
| i-Butane | 0.350896 | 0.350896 | 0.350896 | 0.350896 |
| n-Butane | 0.620823 | 0.620823 | 0.620823 | 0.620823 |
| i-Pentane | 0.0893689 | 0.0893689 | 0.0893689 | 0.0893689 |
| n-Pentane | 0.0624074 | 0.0624074 | 0.0624074 | 0.0624074 |
| Hexane | 0.0276576 | 0.0276576 | 0.0276576 | 0.0276576 |
| Temperature ° F. | 101.540 | −145.335 | −183.260 | 101.727* |

TABLE 2-continued

FLOW STREAM PROPERTIES FOR EXAMPLE 1-SYSTEM 10

| | | | | |
|---|---|---|---|---|
| Pressure psia | 340 | 388.5 | 165* | 160 |
| Mole Fraction Vapor % | 100 | 0 | 23.9490 | 100 |
| | 42.2528 | 17.5* | 17.5 | 17.5 |

| Mole Fraction/Property-Stream No. | 68 | 72 | 76 |
|---|---|---|---|
| Nitrogen | 1.93913 | 1.93913 | 1.91623 |
| CO2 | 0.00694044 | 0.00694044 | 0.00390743 |
| Methane | 88.8955 | 88.8955 | 93.0578 |
| Ethane | 5.89178 | 5.89178 | 3.23637 |
| Propane | 2.11545 | 2.11545 | 1.15643 |
| i-Butane | 0.350896 | 0.350896 | 0.191808 |
| n-Butane | 0.620823 | 0.620823 | 0.339356 |
| i-Pentane | 0.0893689 | 0.0893689 | 0.0488510 |
| n-Pentane | 0.0624074 | 0.0624074 | 0.0341132 |
| Hexane | 0.0276576 | 0.0276576 | 0.0151182 |
| Temperature ° F. | −145.335 | −216.425 | −217.785 |
| Pressure psia | 388.5 | 65* | 57.5 |
| Mole Fraction Vapor % | 0 | 36.8655 | 75.7586 |
| | 8* | 8 | 20.5208 |

| Mole Fraction/Property-Stream No. | 78 | 80 | 84 |
|---|---|---|---|
| Nitrogen | 1.91623 | 59.4154 | 31.3690 |
| CO2 | 0.00390743 | 0.000326395 | 0.00130540 |
| Methane | 93.0578 | 40.4844 | 68.1744 |
| Ethane | 3.23637 | 0.0959951 | 0.435886 |
| Propane | 1.15643 | 0.00367169 | 0.0182156 |
| i-Butane | 0.191808 | 9.24393E−05 | 0.000463516 |
| n-Butane | 0.339356 | 0.000126703 | 0.000635588 |
| i-Pentane | 0.0488510 | 8.01838E−07 | 4.02941E−06 |
| n-Pentane | 0.0341132 | 1.29730E−06 | 6.51837E−06 |
| Hexane | 0.0151182 | 8.00757E−08 | 4.02408E−07 |
| Temperature ° F. | 101.727* | −189.094 | −199.103 |
| Pressure psia | 55 | 385 | 385 |
| Mole Fraction Vapor % | 100 | 100 | 0 |
| Std Vapor Volumetric Flow MMSCFD | 20.5208 | 34.9908 | 6.96253 |

| Mole Fraction/Property-Stream No. | 86 | 90 | 98 |
|---|---|---|---|
| Nitrogen | 66.3824 | 66.3824 | 63.1382 |
| CO2 | 8.31993E−05 | 8.31993E−05 | 9.63111E−05 |
| Methane | 33.6059 | 33.6059 | 36.8482 |
| Ethane | 0.0115625 | 0.0115625 | 0.0134116 |
| Propane | 5.88178E−05 | 5.88178E−05 | 6.84284E−05 |
| i−Butane | 2.59683E−07 | 2.59683E−07 | 3.02222E−07 |
| n-Butane | 2.90617E−07 | 2.90617E−07 | 3.38227E−07 |
| i-Pentane | 7.25370E−11 | 7.25370E−11 | 8.44288E−11 |
| n-Pentane | 3.23020E−10 | 3.23020E−10 | 3.75973E−10 |
| Hexane | 4.85066E−12 | 4.85066E−12 | 5.64582E−12 |
| Temperature ° F. | −199.103 | −223.793 | −223.896 |
| Pressure psia | 385 | 380 | 379 |
| Mole Fraction Vapor % | 100 | 15* | 1.22019 |
| Std Vapor Volumetric Flow MMSCFD | 28.0282 | 28.0282 | 24.0804 |

| Mole Fraction/Property-Stream No. | 102 | 106 | 110 | 114 |
|---|---|---|---|---|
| Nitrogen | 63.1382 | 98.4286 | 98.4286 | 98.4286 |
| CO2 | 9.63111E−05 | 4.30858E−10 | 4.30858E−10 | 4.30858E−10 |
| Methane | 36.8482 | 1.57143 | 1.57143 | 1.57143 |
| Ethane | 0.0134116 | 4.62270E−08 | 4.62270E−08 | 4.62270E−08 |
| Propane | 6.84284E−05 | 5.06148E−13 | 5.06148E−13 | 5.06148E−13 |
| i-Butane | 3.02222E−07 | 0 | 0 | 0 |
| n-Butane | 3.38227E−07 | 0 | 0 | 0 |
| i-Pentane | 8.44288E−11 | 0 | 0 | 0 |
| n-Pentane | 3.75973E−10 | 0 | 0 | 0 |
| Hexane | 5.64582E−12 | 0 | 0 | 0 |
| Temperature ° F. | −275.993 | −290.157 | −299.700 | −228.767 |

TABLE 2-continued

FLOW STREAM PROPERTIES FOR EXAMPLE 1-SYSTEM 10

| | | | | |
|---|---|---|---|---|
| Pressure psia | 70* | 62.5 | 20* | 19 |
| Std Vapor Volumetric Flow MMSCFD | 41.7445 | 100 | 100 | 100 |
| | 24.0804 | 18.7245 | 18.7245 | 18.7245 |

| Mole Fraction/Property-Stream No. | 116 | 118 | 120 |
|---|---|---|---|
| Nitrogen | 98.4286 | 98.4286 | 8.92683 |
| CO2 | 4.30858E−10 | 4.30858E−10 | 0.000178860 |
| Methane | 1.57143 | 1.57143 | 91.0478 |
| Ethane | 4.62270E−08 | 4.62270E−08 | 0.0250017 |
| Propane | 5.06148E−13 | 5.06148E−13 | 0.000145857 |
| i-Butane | 0 | 0 | 7.50615E−07 |
| n-Butane | 0 | 0 | 8.64756E−07 |
| i-Pentane | 0 | 0 | 4.25543E−10 |
| n-Pentane | 0 | 0 | 1.57601E−09 |
| Hexane | 0 | 0 | 1.78131E−11 |
| Temperature ° F. | −204.101* | 101.727* | −245.576 |
| Pressure psia | 18 | 17 | 65 |
| Std Vapor Volumetric Flow MMSCFD | 100 | 100 | 0 |
| | 18.7245 | 18.7245 | 15.2885 |

| Mole Fraction/Property-Stream No. | 124 | 126 | 130 |
|---|---|---|---|
| Nitrogen | 8.92683 | 8.92683 | 7.71205 |
| CO2 | 0.000178860 | 0.000178860 | 0.00135433 |
| Methane | 91.0478 | 91.0478 | 90.6737 |
| Ethane | 0.0250017 | 0.0250017 | 1.04492 |
| Propane | 0.000145857 | 0.000145857 | 0.367883 |
| i-Butane | 7.50615E−07 | 7.50615E−07 | 0.0610024 |
| n-Butane | 8.64756E−07 | 8.64756E−07 | 0.107928 |
| i-Pentane | 4.25543E−10 | 4.25543E−10 | 0.0155364 |
| n-Pentane | 1.57601E−09 | 1.57601 E−09 | 0.0108493 |
| Hexane | 1.78131E−11 | 1.78131E−11 | 0.00480815 |
| Temperature ° F. | −245.576 | −221.201 | −225.657 |
| Pressure psia | 65 | 65 | 65 |
| Std Vapor Volumetric Flow MMSCFD | 0 | 100* | 32.3405 |
| | 5.12485 | 5.12485 | 18.5056 |

| Mole Fraction/Property-Stream No. | 134 | 144 |
|---|---|---|
| Nitrogen | 19.8681 | 86.1708 |
| CO2 | 6.72785E−05 | 3.22226E−06 |
| Methane | 80.1220 | 13.8289 |
| Ethane | 0.00971970 | 0.000283701 |
| Propane | 9.71550E−05 | 1.96930E−07 |
| i-Butane | 7.01445E−07 | 2.08579E−10 |
| n-Butane | 8.48176E−07 | 2.15697E−10 |
| i-Pentane | 7.47518E−10 | 1.60550E−15 |
| n-Pentane | 2.51369E−09 | 2.50524E−14 |
| Hexane | 2.27921E−11 | 5.04462E−16 |
| Temperature ° F. | −225.657 | −223.896 |
| Pressure psia | 65 | 379 |
| Std Vapor Volumetric Flow MMSCFD | 100 | 100 |
| | 5.98481 | 3.94784* |

| Mole Fraction/Property-Stream No. | 146 | 150 | 152 | 156 |
|---|---|---|---|---|
| Nitrogen | 86.1708 | 86.1708 | 1.93913 | 1.93913 |
| CO2 | 3.22226E−06 | 3.22226E−06 | 0.00694044 | 0.00694044 |
| Methane | 13.8289 | 13.8289 | 88.8955 | 88.8955 |
| Ethane | 0.000283701 | 0.000283701 | 5.89178 | 5.89178 |
| Propane | 1.96930E−07 | 1.96930E−07 | 2.11545 | 2.11545 |
| i-Butane | 2.08579E−10 | 2.08579E−10 | 0.350896 | 0.350896 |
| n-Butane | 2.15697E−10 | 2.15697E−10 | 0.620823 | 0.620823 |
| i-Pentane | 1.60550E−15 | 1.60550E−15 | 0.0893689 | 0.0893689 |
| n-Pentane | 2.50524E−14 | 2.50524E−14 | 0.0624074 | 0.0624074 |

TABLE 2-continued

FLOW STREAM PROPERTIES FOR EXAMPLE 1-SYSTEM 10

| | | | | |
|---|---|---|---|---|
| Hexane | 5.04462E−16 | 5.04462E−16 | 0.0276576 | 0.0276576 |
| Temperature ° F. | −295.724* | −294.945 | −145.335 | −214.065 |
| Pressure psia | 374 | 70* | 388.5 | 70* |
| Mole Fraction Vapor % | 0 | 0 | 0 | 36.0482 |
| Std Vapor Volumetric Flow MMSCFD | 3.94784 | 3.94784 | 3.21712 | 3.21712 |

| Mole Fraction/Property-Stream No. | 158 | 162 | 164 |
|---|---|---|---|
| Nitrogen | 1.79515 | 1.79515 | 1.79515 |
| CO2 | 0.00509588 | 0.00509588 | 0.00509588 |
| Methane | 25.8431 | 25.8431 | 25.8431 |
| Ethane | 10.3922 | 10.3922 | 10.3922 |
| Propane | 14.4181 | 14.4181 | 14.4181 |
| i-Butane | 6.42948 | 6.42948 | 6.42948 |
| n-Butane | 17.5478 | 17.5478 | 17.5478 |
| i-Pentane | 6.26342 | 6.26342 | 6.26342 |
| n-Pentane | 5.89497 | 5.89497 | 5.89497 |
| Hexane | 11.4107 | 11.4107 | 11.4107 |
| Temperature ° F. | −17.4875 | −38.8154 | 101.727* |
| Pressure psia | 658.5 | 165* | 160 |
| Mole Fraction Vapor % | 0 | 23.0297 | 53.0054 |
| Std Vapor Volumetric Flow MMSCFD | 1.00183 | 1.00183 | 1.00183 |

| Mole Fraction/Property-Stream No. | 166 | 170 | 172 |
|---|---|---|---|
| Nitrogen | 1.90160 | 1.90160 | 1.90160 |
| CO2 | 0.00196953 | 0.00196953 | 0.00196953 |
| Methane | 95.7172 | 95.7172 | 95.7172 |
| Ethane | 1.53973 | 1.53973 | 1.53973 |
| Propane | 0.543680 | 0.543680 | 0.543680 |
| i-Butane | 0.0901606 | 0.0901606 | 0.0901606 |
| n-Butane | 0.159516 | 0.159516 | 0.159516 |
| i-Pentane | 0.0229626 | 0.0229626 | 0.0229626 |
| n-Pentane | 0.0160351 | 0.0160351 | 0.0160351 |
| Hexane | 0.00710639 | 0.00710639 | 0.00710639 |
| Temperature ° F. | −225.657 | −227.698 | −204.007 |
| Pressure psia | 65 | 60* | 57.5 |
| Mole Fraction Vapor % | 0 | 0.990159 | 96.2238 |
| Std Vapor Volumetric Flow MMSCFD | 12.5208 | 12.5208 | 12.5208 |

| Mole Fraction/Property-Stream No. | 180 | 184 |
|---|---|---|
| Nitrogen | 8.92683 | 8.92683 |
| CO2 | 0.000178860 | 0.000178860 |
| Methane | 91.0478 | 91.0478 |
| Ethane | 0.0250017 | 0.0250017 |
| Propane | 0.000145857 | 0.000145857 |
| i-Butane | 7.50615E−07 | 7.50615E−07 |
| n-Butane | 8.64756E−07 | 8.64756E−07 |
| i-Pentane | 4.25543E−10 | 4.25543E−10 |
| n-Pentane | 1.57601E−09 | 1.57601E−09 |
| Hexane | 1.78131E−11 | 1.78131E−11 |
| Temperature ° F. | −245.576 | −245.576 |
| Pressure psia | 65 | 65 |
| Mole Fraction Vapor % | 0 | 0 |
| Std Vapor Volumetric Flow MMSCFD | 10.1636 | 10.1636 |

It will be appreciated by those of ordinary skill in the art that these values are based on the particular parameters and composition of the feed stream in the above computer simulation example. The temperature, pressure, and compositional values will differ depending on the parameters and composition of the NRU Feed stream 12 and specific operating parameters for various pieces of equipment in system 10.

Example 2—Computer Simulation for 100 MMSCFD Feed with 20% Nitrogen in System 210

Referring to FIG. 2, a system 210 and method for processing a 100 MMSCFD NRU feed stream 12, comprising approximately 20 mol % nitrogen and 72 mol % methane at 120° F. and 614.5 psia based on a computer simulation is shown and described below. Feed stream 12 passes through first heat exchanger 14, which preferably comprises a plate-fin heat exchanger. The feed stream emerges from the heat exchanger and enters separator 18 having been cooled to −74.68° F. as stream 16 (this amount of cooling is greater than in system 10). This cooling is the result of heat exchange with other process streams 56, 64, 276, 316, and 162. The cooled stream 16 is then separated in first separator 18 into an overhead vapor stream 20 and a bottoms liquid stream 158. Bottoms liquid stream 158 comprises around 2.41% nitrogen, 38.6% methane, 17.6% ethane, and 18.5% propane. The pressure of stream 158 is reduced in valve 160 to around 165 psia in mixed liquid-vapor stream 162. Stream 162 is then warmed in heat exchanger 14, exiting as stream 164 at 102.7° F. and 160 psia. Stream 164 may be sent to an NGL stabilizer column (not shown) for further processing.

Overhead vapor stream 20, comprising around 20.9% nitrogen and around 74.6% methane is split in splitter 22 into streams 24 and 34. Stream 24 is then routed for another pass through heat exchanger 14, exiting as a subcooled liquid stream 26 having been cooled to −195° F. Stream 26 passes through a pressure reducing valve 28, exiting as stream 30 with a pressure around 425 psia. Stream 30 feeds into an upper tray level on first fractionating column 32. First fractionating column 32 is preferably a high pressure column upstream of a low pressure second fractionating column 104. Vapor stream 34, the other portion of the first separator overhead stream, passes through the tube side of exchanger 36 in order to provide heat for the reboiler 36 for first fractionating column 32, exiting as mixed liquid-vapor stream 38 having been cooled to around −137.4° F. Around 7.15 million Btu/Hr of heat energy (Q-4) passes from tube side of reboiler 36 (tube) (from stream 34) to shell side of reboiler 36 (shell) (to stream 46). Stream 38 passes through temperature control valve 40 (preferably a throttling valve), exiting as stream 42 with a reduced pressure of around 421.3 psia. Mixed liquid-vapor stream 42 feeds into first fractionating column 32 near a mid-level tray location. Stream 80 comprising around 61.6% nitrogen and 38.3% methane at −190° F. from the top of column 32 feeds into a tube side 82 (tube) of a shell and tube heat exchanger that acts as a condenser for column 32. A liquid portion of stream 80 returns to column 32 as stream 84 and a vapor portion exits tube side 82 (tube) as overhead stream 86 comprising around 77.5% nitrogen and 22.5% methane at −209.85° F. and 415 psia. The amount of nitrogen in overhead stream 86 in system 210 is higher than the similar computer simulation example for system 10 (66% nitrogen) and the amount of methane is lower than the example for system 10 (34% methane), showing greater efficiency in nitrogen removal in system 210. Around 6.07 million Btu/hr of heat energy (Q-1) passes from tube side 82 (tube) to shell side 82 (shell).

First column overhead stream 86 is split in splitter 287 into a first portion stream 289 and a second portion stream 344. Vapor stream 289 passes through second heat exchanger 288, which preferably comprises a plate-fin heat exchanger, exiting as cooled, mixed liquid-vapor stream 298 at −265° F. Stream 298 at −265° F. and 412.5 psia passes through valve 100, existing as stream 302 at −285° F. with a pressure of around 70 psia. Mixed liquid-vapor stream 302 feeds into a mid-level of second fractionating column 104. Vapor stream 344 passes through third heat exchanger 112, which preferably comprises a plate-fin heat exchanger, exiting as stream 346 having been subcooled to around −294° F. Stream 346 then passes through valve 148 to reduce the pressure of exiting stream 350 to around 75 psia. Stream 350 then feeds into an upper level of column 104. A third stream, stream 334 comprising around 42% nitrogen and 58% methane at −236° F. and 64 psia, also feeds into a lower level of column 104 as an ascending vapor stream.

Components of feed streams 350, 302, and 334 are separated in second fractionating column 104 into an overhead stream 306 and a bottoms stream 320. Overhead stream 306 comprises around 97.8% nitrogen and around 2.2% methane at −285° F. and 72.5 psia before passing through valve 108, existing at stream 310 at −297° F. and 20 psia. Stream 310 passes through third heat exchanger 112, exiting as stream 316 warmed to −215° F. Stream 316 then passes through first heat exchanger 14, exiting as stream 318 warmed to around 103° F. Stream 318 is the nitrogen vent stream for system 210.

Bottoms stream 320 comprising around 32% nitrogen and 68% methane at −269° F. and 75 psia is warmed in second heat exchanger 288, exiting as mixed liquid-vapor stream 330 at −236° F. Stream 330 is separated in separator 132 into overhead vapor stream 334 and bottoms liquid stream 366. Stream 334 is returned to second fractionating column 104 as an ascending vapor stream providing heat to the second column as is similar to having a reboiler in second column 104. Bottoms stream 366 comprises around 5% nitrogen and around 95% methane at −236° F. and 64 psia. Stream 366 passes through heat exchanger 288, exiting as mixed liquid-vapor stream 372 having been warmed to −217.5° F. Stream 372 is mixed with a partially vaporized third portion 271 of a bottoms stream from fractionating column 32 (downstream of heat exchange in fourth heat exchanger 82) in mixer 74 to form mixed stream 276.

Liquid stream 46 from a bottom of column 32 passes through reboiler 36 (shell) where there is heat exchange with stream 34 (which is a portion of first separator overhead stream for system 210). A vapor portion 44 of stream 46 returns to the bottom of column 32 and a liquid portion exits as bottoms stream 48 comprising around 2.9% nitrogen and around 91.2% methane at −145° F. and 418.5 psia. Bottoms stream 48 is then split in splitter 50 into streams 52 (first portion), 60 (second portion), and (third portion) Unlike system 10, there is no fourth portion of the first column bottoms stream in system 210. Stream 52 passes through valve 54, exiting as stream 56 at 345 psia. Stream 56 then passes through heat exchanger 14, exiting as stream 58 having been warmed to around 103° F. and at a pressure of 340 psia. Stream 58 is one of the three sales gas streams. Stream 60 passes through valve 62, exiting as stream 64 at −185° F. and a pressure of 165 psia. Stream 64 then passes through heat exchanger 14, exiting as stream 66 having been warmed to around 103° F. and a pressure of 160 psia. Stream 66 is a second of the sales gas streams. Stream 68 passes through valve 70, exiting as stream 269 having been cooled to −214° F. at a pressure of 75 psia. Stream 269 is a refrigerant for heat exchanger 82, exiting as stream 271 warmed to −194.7° F. Stream 271 is mixed with stream 372 in mixer 74 to form stream 276 at −206° F. and 72.5 psia, which passes through heat exchanger 14 exiting as stream 378 at 102.7° F. and 70 psia. Stream 378 is a third sales gas stream. Of the sales gas streams, stream 58 is a high pressure stream (higher than streams 66 and 378) and depending on the requirements of the installation, this stream may not need further compression to enter existing facility equipment or the compression requirements would be significantly reduced when compared with existing nitrogen rejection technologies. Stream 66 is an intermediate pressure stream (lower pressure than stream 58 but higher pressure than stream 378), and stream 378 is a low pressure stream (lower pressure than streams 58 and 66). These streams 66 and 378 may be further compressed as needed to meet pipeline requirements.

The specific flow rates, temperatures, pressures, and compositions of various flow streams referred to in connection with the above discussion of a computer simulation for a system 210 appear in Table 3 below. These values are based on a feed gas stream 12 comprising 20% nitrogen, around 73% methane, and 50 ppm of carbon dioxide with a flow rate of 100 MMSCFD.

TABLE 3

FLOW STREAM PROPERTIES FOR EXAMPLE 2-SYSTEM 210

| Mole Fraction/Property-Stream No. | 12 | 16 | 20 | 24 |
|---|---|---|---|---|
| Nitrogen | 20.0000* | 20.0000 | 20.9263 | 20.9263 |
| CO2 | 0.005* | 0.005 | 0.00479276 | 0.00479276 |
| Methane | 72.7672* | 72.7672 | 74.5651 | 74.5651 |
| Ethane | 4.28875* | 4.28875 | 3.58786 | 3.58786 |
| Propane | 1.64580* | 1.64580 | 0.756602 | 0.756602 |
| i-Butane | 0.313443* | 0.313443 | 0.0621838 | 0.0621838 |
| n-Butane | 0.616397* | 0.616397 | 0.0867579 | 0.0867579 |
| i-Pentane | 0.126174* | 0.126174 | 0.00579575 | 0.00579575 |
| n-Pentane | 0.103348* | 0.103348 | 0.00376879 | 0.00376879 |
| Hexane | 0.133944* | 0.133944 | 0.000813590 | 0.000813590 |
| Temperature ° F | 120* | −74.6841 | −74.7642 | −74.7642 |
| Pressure psia | 614.5* | 609.5 | 608.5 | 608.5 |
| Mole Fraction Vapor % | 100 | 95* | 100 | 100 |
| Std Vapor Volumetric Flow MMSCFD | 100* | 100 | 94.9975 | 52.1944 |

| Mole Fraction/Property-Stream No. | 26 | 30 | 34 |
|---|---|---|---|
| Nitrogen | 20.9263 | 20.9263 | 20.9263 |
| CO2 | 0.00479276 | 0.00479276 | 0.00479276 |
| Methane | 74.5651 | 74.5651 | 74.5651 |
| Ethane | 3.58786 | 3.58786 | 3.58786 |
| Propane | 0.756602 | 0.756602 | 0.756602 |
| i-Butane | 0.0621838 | 0.0621838 | 0.0621838 |
| n-Butane | 0.0867579 | 0.0867579 | 0.0867579 |
| i-Pentane | 0.00579575 | 0.00579575 | 0.00579575 |
| n-Pentane | 0.00376879 | 0.00376879 | 0.00376879 |
| Hexane | 0.000813590 | 0.000813590 | 0.000813590 |
| Temperature ° F | −195* | −195.215 | −74.7642 |
| Pressure psia | 603.5 | 425* | 608.5 |
| Mole Fraction Vapor % | 0 | 0 | 100 |
| Std Vapor Volumetric Flow MMSCFD | 52.1944 | 52.1944 | 42.8031 |

| Mole Fraction/Property-Stream No. | 38 | 42 | 44 | 46 |
|---|---|---|---|---|
| Nitrogen | 20.9263 | 20.9263 | 9.59387 | 4.84624 |
| CO2 | 0.00479276 | 0.00479276 | 0.00165300 | 0.00494659 |
| Methane | 74.5651 | 74.5651 | 89.8808 | 90.7982 |
| Ethane | 3.58786 | 3.58786 | 0.502344 | 3.49065 |
| Propane | 0.756602 | 0.756602 | 0.0205138 | 0.711218 |
| i-Butane | 0.0621838 | 0.0621838 | 0.000405626 | 0.0580783 |
| n-Butane | 0.0867579 | 0.0867579 | 0.000455393 | 0.0809976 |
| i-Pentane | 0.00579575 | 0.00579575 | 3.26962E−06 | 0.00540297 |
| n-Pentane | 0.00376879 | 0.00376879 | 3.70709E−06 | 0.00351384 |
| Hexane | 0.000813590 | 0.000813590 | 1.39212E−07 | 0.000758359 |
| Temperature ° F. | −137.351* | −154.446 | −144.791 | −150.370 |
| Pressure psia | 603.5 | 421.273* | 418.5 | 418.5 |
| Mole Fraction Vapor % | 61.4339 | 64.9859 | 100 | 0 |
| Std Vapor Volumetric Flow MMSCFD | 42.8031 | 42.8031 | 29.9047 | 101.922 |

| Mole Fraction/Property-Stream No. | 48 | 52 | 56 |
|---|---|---|---|
| Nitrogen | 2.87481 | 2.87481 | 2.87481 |
| CO2 | 0.00631423 | 0.00631423 | 0.00631423 |
| Methane | 91.1792 | 91.1792 | 91.1792 |
| Ethane | 4.73153 | 4.73153 | 4.73153 |
| Propane | 0.998029 | 0.998029 | 0.998029 |
| i-Butane | 0.0820266 | 0.0820266 | 0.0820266 |
| n-Butane | 0.114442 | 0.114442 | 0.114442 |

TABLE 3-continued

FLOW STREAM PROPERTIES FOR EXAMPLE 2-SYSTEM 210

| | | | |
|---|---|---|---|
| i-Pentane | 0.00764517 | 0.00764517 | 0.00764517 |
| n-Pentane | 0.00497141 | 0.00497141 | 0.00497141 |
| Hexane | 0.00107321 | 0.00107321 | 0.00107321 |
| Temperature ° F. | −144.791 | −144.791 | −154.003 |
| Pressure psia | 418.5 | 418.5 | 345* |
| Mole Fraction Vapor % | 0 | 0 | 8.75183 |
| Std Vapor Volumetric Flow MMSCFD | 72.0169 | 32.0169 | 32.0169 |

| Mole Fraction/Property-Stream No. | 58 | 60 | 64 | 66 |
|---|---|---|---|---|
| Nitrogen | 2.87481 | 2.87481 | 2.87481 | 2.87481 |
| CO2 | 0.00631423 | 0.00631423 | 0.00631423 | 0.00631423 |
| Methane | 91.1792 | 91.1792 | 91.1792 | 91.1792 |
| Ethane | 4.73153 | 4.73153 | 4.73153 | 4.73153 |
| Propane | 0.998029 | 0.998029 | 0.998029 | 0.998029 |
| i-Butane | 0.0820266 | 0.0820266 | 0.0820266 | 0.0820266 |
| n-Butane | 0.114442 | 0.114442 | 0.114442 | 0.114442 |
| i-Pentane | 0.00764517 | 0.00764517 | 0.00764517 | 0.00764517 |
| n-Pentane | 0.00497141 | 0.00497141 | 0.00497141 | 0.00497141 |
| Hexane | 0.00107321 | 0.00107321 | 0.00107321 | 0.00107321 |
| Temperature ° F | 102.756 | −144.791 | −185.758 | 102.757* |
| Pressure psia | 340 | 418.5 | 165* | 160 |
| Mole Fraction Vapor % | 100 | 0 | 27.2528 | 100 |
| Std Vapor Volumetric Flow MMSCFD | 32.0169 | 10* | 10 | 10 |

| Mole Fraction/Property-Stream No. | 68 | 269 | 271 |
|---|---|---|---|
| Nitrogen | 2.87481 | 2.87481 | 2.87481 |
| CO2 | 0.00631423 | 0.00631423 | 0.00631423 |
| Methane | 91.1792 | 91.1792 | 91.1792 |
| Ethane | 4.73153 | 4.73153 | 4.73153 |
| Propane | 0.998029 | 0.998029 | 0.998029 |
| i-Butane | 0.0820266 | 0.0820266 | 0.0820266 |
| n-Butane | 0.114442 | 0.114442 | 0.114442 |
| i-Pentane | 0.00764517 | 0.00764517 | 0.00764517 |
| n-Pentane | 0.00497141 | 0.00497141 | 0.00497141 |
| Hexane | 0.00107321 | 0.00107321 | 0.00107321 |
| Temperature ° F | −144.791 | −213.887 | −194.720 |
| Pressure psia | 418.5 | 75* | 72.5 |
| Mole Fraction Vapor % | 0 | 38.0720 | 89.8426 |
| Std Vapor Volumetric Flow MMSCFD | 30* | 30 | 30 |

| Mole Fraction/Property-Stream No. | 80 | 84 | 86 |
|---|---|---|---|
| Nitrogen | 61.6377 | 47.9156 | 77.4962 |
| CO2 | 0.000263415 | 0.000469946 | 2.47286E−05 |
| Methane | 38.2840 | 51.9416 | 22.5000 |
| Ethane | 0.0759625 | 0.138410 | 0.00379258 |
| Propane | 0.00202842 | 0.00377091 | 1.46279E−05 |
| i-Butane | 2.96717E−05 | 5.53060E−05 | 4.62839E−08 |
| n-Butane | 3.33338E−05 | 6.21379E−05 | 4.50275E−08 |
| i-Pentane | 1.10636E−07 | 2.06361E−07 | 6.17194E−12 |
| n-Pentane | 1.71614E−07 | 3.20085E−07 | 2.74717E−11 |
| Hexane | 7.36483E−09 | 1.37369E−08 | 6.35870E−13 |
| Temperature ° F. | −190.214 | −209.857 | −209.857 |
| Pressure psia | 415 | 415 | 415 |
| Mole Fraction Vapor % | 100 | 0 | 100 |
| Std Vapor Volumetric Flow MMSCFD | 49.5392 | 26.5586 | 22.9806 |

| Mole Fraction/Property-Stream No. | 289 | 298 | 302 |
|---|---|---|---|
| Nitrogen | 77.4962 | 77.4962 | 77.4962 |
| CO2 | 2.47286E−05 | 2.47286E−05 | 2.47286E−05 |
| Methane | 22.5000 | 22.5000 | 22.5000 |
| Ethane | 0.00379258 | 0.00379258 | 0.00379258 |
| Propane | 1.46279E−05 | 1.46279E−05 | 1.46279E−05 |

TABLE 3-continued

FLOW STREAM PROPERTIES FOR EXAMPLE 2-SYSTEM 210

| | | | |
|---|---|---|---|
| i-Butane | 4.62839E−08 | 4.62839E−08 | 4.62839E−08 |
| n-Butane | 4.50275E−08 | 4.50275E−08 | 4.50275E−08 |
| i-Pentane | 6.17194E−12 | 6.17194E−12 | 6.17194E−12 |
| n-Pentane | 2.74717E−11 | 2.74717E−11 | 2.74717E−11 |
| Hexane | 6.35870E−13 | 6.35870E−13 | 6.35870E−13 |
| Temperature ° F. | −209.857 | −265* | −285.411 |
| Pressure psia | 415 | 412.5 | 70* |
| Mole Fraction Vapor % | 100 | 0 | 14.7122 |
| Std Vapor Volumetric Flow MMSCFD | 18.9976 | 18.9976 | 18.9976 |

| Mole Fraction/Property-Stream No. | 344 | 346 | 350 | 306 |
|---|---|---|---|---|
| Nitrogen | 77.4962 | 77.4962 | 77.4962 | 97.7679 |
| CO2 | 2.47286E−05 | 2.47286E−05 | 2.47286E−05 | 5.10442E−09 |
| Methane | 22.5000 | 22.5000 | 22.5000 | 2.23207 |
| Ethane | 0.00379258 | 0.00379258 | 0.00379258 | 7.74273E−07 |
| Propane | 1.46279E−05 | 1.46279E−05 | 1.46279E−05 | 5.11716E−11 |
| i-Butane | 4.62839E−08 | 4.62839E−08 | 4.62839E−08 | 0 |
| n-Butane | 4.50275E−08 | 4.50275E−08 | 4.50275E−08 | 2.72021E−14 |
| i-Pentane | 6.17194E−12 | 6.17194E−12 | 6.17194E−12 | 0 |
| n-Pentane | 2.74717E−11 | 2.74717E−11 | 2.74717E−11 | 0 |
| Hexane | 6.35870E−13 | 6.35870E−13 | 6.35870E−13 | 0 |
| Temperature ° F. | −209.857 | −293.599* | −292.620 | −285.458 |
| Pressure psia | 415 | 410 | 75* | 72.5 |
| Mole Fraction Vapor % | 100 | 0 | 0 | 100 |
| Std Vapor Volumetric Flow MMSCFD | 3.98301* | 3.98301 | 3.98301 | 17.4079 |

| Mole Fraction/Property-Stream No. | 310 | 316 | 318 |
|---|---|---|---|
| Nitrogen | 97.7679 | 97.7679 | 97.7679 |
| CO2 | 5.10442E−09 | 5.10442E−09 | 5.10442E−09 |
| Methane | 2.23207 | 2.23207 | 2.23207 |
| Ethane | 7.74273E−07 | 7.74273E−07 | 7.74273E−07 |
| Propane | 5.11716E−11 | 5.11716E−11 | 5.11716E−11 |
| i-Butane | 0 | 0 | 0 |
| n-Butane | 2.72021E−14 | 2.72021E−14 | 2.72021E−14 |
| i-Pentane | 0 | 0 | 0 |
| n-Pentane | 0 | 0 | 0 |
| Hexane | 0 | 0 | 0 |
| Temperature ° F. | −296.961 | −214.763 | 102.757* |
| Pressure psia | 20* | 19 | 18 |
| Mole Fraction Vapor % | 100 | 100 | 100 |
| Std Vapor Volumetric Flow MMSCFD | 17.4079 | 17.4079 | 17.4079 |

| Mole Fraction/Property-Stream No. | 320 | 330 | 334 |
|---|---|---|---|
| Nitrogen | 32.4611 | 30.0413 | 42.3124 |
| CO2 | 3.73729E−05 | 4.67684E−05 | 2.58363E−06 |
| Methane | 67.5333 | 69.9510 | 57.6875 |
| Ethane | 0.00552599 | 0.00765791 | 7.95320E−05 |
| Propane | 2.11247E−05 | 4.56127E−05 | 1.11114E−08 |
| i-Butane | 6.68191E−08 | 2.67431E−07 | 2.41581E−12 |
| n-Butane | 6.50051E−08 | 3.21385E−07 | 2.00276E−12 |
| i-Pentane | 8.91010E−12 | 8.63913E−11 | 2.07022E−18 |
| n-Pentane | 3.96594E−11 | 3.99677E−10 | 6.00004E−17 |
| Hexane | 9.17972E−13 | 1.57875E−11 | 4.74668E−20 |
| Temperature ° F. | −269.184 | −236.193 | −236.193 |
| Pressure psia | 75 | 64 | 64 |
| Mole Fraction Vapor % | 0 | 67.0987 | 100 |
| Std Vapor Volumetric Flow MMSCFD | 15.9185 | 15.4186 | 10.3457 |

| Mole Fraction/Property-Stream No. | 366 | 370 | 372 |
|---|---|---|---|
| Nitrogen | 5.01559 | 5.01559 | 5.01559 |
| CO2 | 0.000136879 | 0.000136879 | 0.000136879 |
| Methane | 94.9610 | 94.9610 | 94.9610 |

TABLE 3-continued

| FLOW STREAM PROPERTIES FOR EXAMPLE 2-SYSTEM 210 | | | |
|---|---|---|---|
| Ethane | 0.0231132 | 0.0231132 | 0.0231132 |
| Propane | 0.000138612 | 0.000138612 | 0.000138612 |
| i-Butane | 8.12824E−07 | 8.12824E−07 | 8.12824E−07 |
| n-Butane | 9.76814E−07 | 9.76814E−07 | 9.76814E−07 |
| i-Pentane | 2.62578E−10 | 2.62578E−10 | 2.62578E−10 |
| n-Pentane | 1.21478E−09 | 1.21478E−09 | 1.21478E−09 |
| Hexane | 4.79843E−11 | 4.79843E−11 | 4.79843E−11 |
| Temperature ° F. | −236.193 | −236.241 | −217.466 |
| Pressure psia | 64 | 80* | 79 |
| Mole Fraction Vapor % | 0 | 0 | 35.1102 |
| Std Vapor Volumetric Flow MMSCFD | 5.07292 | 5.07292 | 5.07292 |
| Mole Fraction/Property-Stream No. | 276 | 378 | 158 |
| Nitrogen | 3.18445 | 3.18445 | 2.40974 |
| CO2 | 0.00542075 | 0.00542075 | 0.00893552 |
| Methane | 91.7262 | 91.7262 | 38.6237 |
| Ethane | 4.05051 | 4.05051 | 17.5985 |
| Propane | 0.853695 | 0.853695 | 18.5315 |
| i-Butane | 0.0701625 | 0.0701625 | 5.08483 |
| n-Butane | 0.0978896 | 0.0978896 | 10.6742 |
| i-Pentane | 0.00653938 | 0.00653938 | 2.41214 |
| n-Pentane | 0.00425235 | 0.00425235 | 1.99434 |
| Hexane | 0.000917979 | 0.000917979 | 2.66208 |
| Temperature ° F. | −205.936 | 102.757* | −74.7642 |
| Pressure psia | 72.5 | 70 | 608.5 |
| Mole Fraction Vapor % | 84.6009 | 100 | 0 |
| Std Vapor Volumetric Flow MMSCFD | 35.0729 | 35.0729 | 5.00253 |

| Mole Fraction/Property-Stream No. | 162 | 164 |
|---|---|---|
| Nitrogen | 2.40974 | 2.40974 |
| CO2 | 0.00893552 | 0.00893552 |
| Methane | 38.6237 | 38.6237 |
| Ethane | 17.5985 | 17.5985 |
| Propane | 18.5315 | 18.5315 |
| i-Butane | 5.08483 | 5.08483 |
| n-Butane | 10.6742 | 10.6742 |
| i-Pentane | 2.41214 | 2.41214 |
| n-Pentane | 1.99434 | 1.99434 |
| Hexane | 2.66208 | 2.66208 |
| Temperature ° F. | −109.565 | 102.757* |
| Pressure psia | 165* | 160 |
| Mole Fraction Vapor % | 27.8845 | 93.1194 |
| Std Vapor Volumetric Flow MMSCFD | 5.00253 | 5.00253 |

It will be appreciated by those of ordinary skill in the art that these values in Example 2 are based on the particular parameters and composition of the feed stream in the above computer simulation example. The temperature, pressure, and compositional values will differ depending on the parameters and composition of the NRU Feed stream 12 and specific operating parameters for various pieces of equipment in system 210.

For inlet feed conditions in Example 1 or in Example 2, a prior art single column design would require around 11,000 hp (or around 110 hp per inlet feed MMSCF of gas); however, a preferred embodiment of the invention according to FIG. 1 or FIG. 2 can process that inlet gas feed stream using only 6,650 hp, which is around 60% of the horsepower required in the prior art system. That difference equates to around $4,300,000 in installed cost plus the added fuel demand that are saved using a preferred embodiment of the invention as depicted in FIG. 1 over prior art single column designs. The operating cost savings over the capital cost differential between a prior art single column and two column system according to the preferred embodiment in FIG. 1 would be around 25% of the total installed costs.

When nitrogen levels are around 20% (as in Examples 1 and 2), it is preferred to use system 210 and the corresponding method described herein, which has less complex process flows, requires fewer pieces of equipment, and generally results in a low pressure sales gas stream with a higher pressure than in system 10. However, system 10 is preferred when nitrogen content of feed stream 12 is substantially above 20%, most preferably around 40 to 75%.

According to another preferred embodiment, a natural gas expander may be used in place of valve 108 in either system 10 or system 210, which would provide a higher degree of cooling of the second column overhead stream than with the valve alone. For example, where the differential across the valve (stream 106 to stream 110 or stream 306 to 310) is calculated to be approximately 10° F., the differential across an expander is approximately 37° F. This higher degree of cooling results in a slightly higher purity of nitrogen to be vented in stream 118 or stream 318 of approximately 0.5 to 1 percent higher nitrogen quality than when a valve 108 alone is used, but also significantly reduces the residue compression required. With a standard control valve in the position of valve 108 the amount of compression is calculated to be approximately 66.5 BHP/MMSCF of inlet gas. The calculated residue HP required with the expander in place instead of the valve 108 is approximately 56.4 BHP/MMSCF. This represents a near 18% reduction in compression HP along with the associated reduction in fuel or power and the associated reduction in environmental impact.

It will also be appreciated by those of ordinary skill in the art upon reading this disclosure that references to separation of nitrogen and methane used herein refer to processing an NRU feed gas to produce various multi-component product streams containing large amounts of the particular desired component, but not pure streams of any particular component. One of those product streams is a nitrogen vent stream, which is primarily comprised of nitrogen but may have small amounts of other components, such as methane and ethane. Other product streams are processed gas streams, or sales gas streams, which are primarily comprised of methane but may have small amounts of other components, such as nitrogen, ethane, and propane. Amounts of components in the various streams described herein as a percentage are mole fraction percentage. All numeric range values indicated herein include each individual numeric value within those ranges and any and all subset combinations within ranges, including subsets that overlap from one preferred range to a more preferred range.

It will also be appreciated by those of ordinary skill in the art upon reading this disclosure that additional processing sections for removing carbon dioxide, water vapor, and possibly other components or contaminants that are present in the NRU feed stream, can also be included in the system and method of the invention, depending upon factors such as, for example, the origin and intended disposition of the product streams and the amounts of such other gases, impurities or contaminants as are present in the NRU feed stream. Other alterations and modifications of the invention will likewise become apparent to those of ordinary skill in the art upon reading this specification in view of the accompanying drawings, and it is intended that the scope of the invention disclosed herein be limited only by the broadest interpretation of the appended claims to which the inventor is legally entitled.

I claim:

1. A system for removing nitrogen and for producing a methane product stream from a feed stream comprising nitrogen, methane, and other components, the system comprising:

a first separator wherein the feed stream is separated into a first separator overhead stream and a first separator bottoms stream;

a first splitter for splitting the first separator overhead stream into a first portion and a second portion;

a first fractionating column wherein the first and the second portions of the first separator overhead stream are separated into a first column overhead stream and a first column bottoms stream;

a second splitter for splitting the first column bottoms stream into a first portion, a second portion, and a third portion;

a second fractionating column wherein the first column overhead stream is separated into a second column overhead stream and a second column bottoms stream;

a second separator wherein the second column bottoms stream is separated into a second separator overhead stream and a second separator bottoms stream;

a first mixer to mix the second separator bottoms stream and the third portion of the first column bottoms stream to form a first mixed stream;

a first heat exchanger wherein the feed stream is cooled upstream of the first separator and the first portion of the first separator overhead stream is cooled upstream of the first fractionating column through heat exchange with the first separator bottoms stream, the first portion of the first column bottoms stream, the second portion of the first column bottoms stream, the first mixed stream, and the second column overhead stream;

wherein the first portion of the first column bottoms stream is a high pressure sales gas stream having a pressure between 315 and 465 psia;

wherein the second portion of the first column bottoms stream is an intermediate pressure sales gas stream having a pressure between 75 and 215 psia; and wherein the first mixed stream is a low pressure sales gas stream having a pressure between 45 and 115 psia.

2. The system of claim 1 wherein heat exchange in the first heat exchanger occurs simultaneously between each of the feed stream, the first portion of the first separator overhead stream, the first separator bottoms stream, the first portion of the first column bottoms stream, the second portion of the first column bottoms stream, the first mixed stream, and the second column overhead stream; and wherein the first heat exchange comprises a single plate-fin heat exchanger.

3. The system of claim 1 wherein an entirety of the feed stream and the first portion of the first separator overhead stream are simultaneously cooled in the first heat exchanger; and wherein the first heat exchanger comprises a single plate-fin heat exchanger.

4. The system of claim 1 further comprising a Joule Thompson (JT) valve through which the first portion of the first separator overhead stream passes downstream of the first heat exchanger and upstream of the first fractionating column.

5. The system of claim 4 wherein the first portion of the first separator overhead stream feeds into the first fractionating column at a lower temperature and lower pressure than the second portion of the first separator overhead feeds into the first fractionating column.

6. The system of claim 5 further comprising a reboiler for the first fractionating column, wherein the reboiler is supplied with heat from the second portion of the first separator overhead stream prior to feeding into the first fractionating column.

7. The system of claim 1 wherein the feed stream is cooled to a temperature in a range of 0 to −75° F. in the first heat exchanger.

8. The system of claim 7 wherein heat exchange in the first heat exchanger occurs simultaneously between each of the feed stream, the first portion of the first separator overhead stream, the first separator bottoms stream, the first portion of the first column bottoms stream, the second portion of the first column bottoms stream, the first mixed stream, and the second column overhead stream.

9. The system of claim 8 the first heat exchange comprises a single plate-fin heat exchanger.

10. The system of claim 1 wherein the first fractionating column is operated at a pressure between 315 and 415 psia and the second fractionating column is operated at a pressure between 65 and 115 psia.

11. The system of claim 10 further comprising:

a third splitter for splitting the first column overhead stream into a first portion and a second portion; and a second heat exchanger wherein the first portion of the first column overhead stream is cooled upstream of the second fractionating column through heat exchange with the second column bottoms stream and the second separator bottoms stream.

12. The system of claim 11 further comprising a third heat exchanger wherein the second portion of the first column overhead stream is cooled upstream of the second fractionating column through heat exchange with the second column overhead stream; and an expander or an expansion valve for expanding the second column overhead stream upstream of the third heat exchanger.

13. The system of claim 12 wherein a temperature of the second column overhead stream exiting the third heat exchanger is 60 to 95° F. colder than a temperature of the second portion of the first column overhead stream prior to entering the third heat exchanger.

14. The system of claim 12 further comprising a fourth heat exchanger for partially condensing a stream from a top portion of the first fractionating column through heat exchange with the third portion of the first column bottoms stream upstream of the first mixer;

wherein a liquid portion from the partially condensed stream from the top portion of the first fractionating column is returned to the first fractionating column as a reflux stream and a vapor portion of the partially condensed stream from the top portion of the first fractionating column is the first column overhead stream.

15. The system of claim 14 further comprising:

a first valve through which the first portion of the first column bottoms stream passes to partially vaporize the first portion of the first column bottoms stream upstream of the first heat exchanger;

a second valve through which the second portion of the first column bottoms stream passes to partially vaporize the second portion of the first column bottoms stream upstream of the first heat exchanger; and a third valve through which the third portion of the first column bottoms stream passes to partially vaporize the third portion of the first column bottoms stream upstream of the fourth heat exchanger.

16. The system of claim 15 wherein the second separator overhead stream feeds into a bottom portion of the second fractionating column as an ascending vapor stream.

17. A method for removing nitrogen from a feed stream comprising nitrogen and methane, the method comprising the steps of:

separating the feed stream into a first separator overhead stream and a first separator bottoms stream in a first separator;

dividing the first separator overhead stream into a first portion and a second portion in a first splitter;

separating the first and the second portions of the first separator overhead stream into a first column overhead stream and a first column bottoms stream in a first fractionating column operated at a pressure between 315 and 415 psia;

dividing the first column bottoms stream into a first portion, a second portion, and a third portion in a second splitter;

separating the first column overhead stream into a second column overhead stream and a second column bottoms stream in a second fractionating column operated at a pressure between 65 and 115 psia;

separating the second column bottoms stream into a second separator overhead stream and a second separator bottoms stream in a second separator;

mixing the second separator bottoms stream and the third portion of the first column bottoms stream to form a first mixed stream in a first mixer;

cooling the feed stream upstream of the first separator and cooling the first portion of the first separator overhead stream upstream of the first fractionating column through heat exchange with the first separator bottoms stream, the first portion of the first column bottoms stream, the second portion of the first column bottoms stream, the first mixed stream, and the second column overhead stream in a first heat exchanger;

wherein the first portion of the first column bottoms stream is a high pressure sales gas stream having a pressure between 315 and 465 psia;

wherein the second portion of the first column bottoms stream is an intermediate pressure sales gas stream having a pressure between 75 and 215 psia; and wherein the first mixed stream is a low pressure sales gas stream having a pressure between 45 and 115 psia.

18. The method of claim 17 further comprising:

partially vaporizing the first and the second portions of the first column bottoms stream upstream of the first heat exchanger; and partially vaporizing the third portion of the first column bottoms stream upstream of the first mixer.

19. The method of claim 17 further comprising:

dividing the first column overhead stream into a first portion and a second portion in a third splitter upstream of the second fractionating column;

cooling the first portion of the first column overhead stream upstream of the second fractionating column through heat exchange with the second column bottoms stream and second separator bottoms stream in a second heat exchanger;

cooling the second portion of the first column overhead stream upstream of feeding into a top portion of the second fractionating column through heat exchange with the second column overhead stream in a third heat exchanger.

20. The method of claim 19 further comprising expanding the second column overhead stream upstream of the third heat exchanger through an expander or an expansion valve.

21. The method of claim 19 further comprising:

partially vaporizing the first and the second portions of the first column bottoms stream upstream of the first heat exchanger;

partially condensing a stream from a top portion of the first fractionating column through heat exchange with the third portion of the first column bottoms stream in a fourth heat exchanger, wherein a liquid portion from the partially condensed stream is returned to the first fractionating column as a reflux stream and a vapor portion of the partially condensed stream is the first column overhead stream; and partially vaporizing the third portion of the first column bottoms stream upstream of the fourth heat exchanger.

22. The method of claim 21 further comprising:

expanding the first portion of the first separator overhead stream through a JT valve downstream of the first heat exchanger and prior to the first portion of the first separator overhead stream feeding into the first fractionating column;

supplying reboiler heat to the first fractionating column from the second portion of the first separator overhead stream prior to the second portion of the first separator overhead stream feeding into the first fractionating column; and wherein the first portion of the first separator overhead stream feeds into the first fractionating column at a lower temperature and lower pressure than the second portion of the first separator overhead stream.

* * * * *